US005281083A

United States Patent [19]

Ito et al.

[11] Patent Number: 5,281,083

[45] Date of Patent: Jan. 25, 1994

[54] VORTEX FLOW BLOWER

[75] Inventors: Eiichi Ito, Narashino; Susumu Yamazaki, Tsuchiura; Masayuki Fujio, Sakura; Toshiharu Yoshidomi, Funabashi; Hiroshi Asabuki, Sakura; Kazuo Kobayashi, Chiba, all of Japan

[73] Assignee: Hitachi, Ltd., Tokyo, Japan

[21] Appl. No.: 900,932

[22] Filed: Jun. 18, 1992

Related U.S. Application Data

[63] Continuation-in-part of Ser. No. 760,347, Sep. 16, 1991.

[30] Foreign Application Priority Data

Jun. 18, 1991 [JP] Japan ..... 3-145786
Sep. 5, 1991 [JP] Japan ..... 3-225641

[51] Int. Cl.[5] ..... F04D 5/00

[52] U.S. Cl. ..... 415/55.1; 415/55.2; 415/55.4

[58] Field of Search ..... 415/55.1, 55.2, 55.3, 415/55.4, 55.5

[56] References Cited

U.S. PATENT DOCUMENTS

| | | | |
|---|---|---|---|
| 1,976,896 | 10/1934 | Siemen et al. | 415/55.1 |
| 2,015,200 | 9/1935 | Spoor | 415/55.1 |
| 2,282,569 | 5/1942 | Fabig | 415/55.1 |
| 3,280,752 | 10/1966 | Luhmann | 415/55.2 |
| 3,402,669 | 9/1968 | Mamo | 415/55.1 |
| 4,500,253 | 2/1985 | Harberl | 415/55.2 |
| 5,160,249 | 11/1992 | Iwai et al. | 415/55.2 |

FOREIGN PATENT DOCUMENTS

| | | | |
|---|---|---|---|
| 2714459 | 1/1978 | Fed. Rep. of Germany | 415/55.2 |
| 1385066 | 11/1964 | France | 415/55.1 |
| 2243650 | 11/1991 | United Kingdom | 415/55.1 |

*Primary Examiner*—John T. Kwon
*Attorney, Agent, or Firm*—Antonelli, Terry, Stout & Kraus

[57] ABSTRACT

A vortex flow blower including a blower casing having an annular flow passageway extending from an inlet port for receiving fluid to an outlet port for discharging the fluid, the outlet port being disposed adjacent to the inlet port, and an impeller accommodated in the blower casing for producing a vortex flow of the fluid in the annular flow passageway. The vortex flow blower is configured for enabling at least one of noise reduction pressure increase and reduction of power requirements of the vortex flow blower, by providing at least one of sectional area reducer for reducing a sectional area of the annular flow passageway which annular flow passageway includes an annular groove disposed in facing relation to vanes of the impeller, and a partition wall partitioning a part of the circumference of the annular groove so that the inlet port and the outlet port being provided at opposite end portions of the annular groove partitioned by the partition wall with the sectional area reducer is disposed at a position of the annular passageway located between the outlet port of the annular passageway and a midpoint between the inlet port and the outlet port of the annular passageway, and an auxiliary flow supply path for supplying an auxiliary flow of the fluid introduced to the annular flow passageway from the inlet port so as to conduct the fluid in a direction to form the vortex flow.

38 Claims, 22 Drawing Sheets

VORTEX FLOW BLOWER

CROSS-REFERENCE TO RELATED APPLICATION

This application is a continuation-in-part application of copending U.S. patent application Ser. No. 760,347, filed Sept. 16, 1991, the subject matter of which is incorporated by reference herein.

BACKGROUND OF THE INVENTION

The present invention relates to the construction of a vortex flow blower for improving performance thereof when such vortex flow blower is operated as a centrifugal gas pump or a centrifugal fluid pump such as a WESCO pump.

This type of vortex blower as a centrifugal pump is generally provided with an impeller having a large number of vanes and disposed in an annular flow path, an inlet or suction port and an outlet or discharge port both communicate with the interior of the annular flow path, and a partition wall for partitioning the section from the discharge port to the suction port through a very small gap with respect to a vane passing path. Gas or liquid (both will be generically called "fluid" hereinafter) which has been introduced from the suction port is rotated and pressurized in the form of a vortex flow in the annular flow path by rotating the impeller disposed in the same path, and the fluid is then discharged from the discharge port.

In prior art single-side impeller type centrifugal pumps, as described for example in Laid-Open Japanese Patent Application No. 51-70512, an annular groove in a casing is made nearly in a semi-elliptical form expressed by $d<(D2-D1)/4$ where D2 is the outside diameter of the annular groove, D1 is inside diameter, and d is depth, thereby preventing the reverse flow of a fluid. It is, therefore, possible to provide a small-volume but high-static pressure centrifugal blower.

Also, in prior-art double-side blade-type centrifugal pumps, the annular groove of the casing is provided with an annular projection on the outer periphery of the annular groove as described in Laid-Open Japanese Patent Application No. 49-135209, thereby improving pump output performance by preventing occurrence of a breakaway flow.

The prior art described above are concerned with producing a high static pressure within a range of small air volume, and a construction required for noise reduction is not taken into consideration. Furthermore, such above-described prior art having projections and shallow grooves provided all around the annular groove, have such a problem as a decrease in the sectional area of a portion extending from a suction port of the annular groove to a suction-discharge center and accordingly a decrease in the air volume. This decrease in the sectional area of this position hardly contributes toward the noise reduction.

Additionally, while the above-described type of a centrifugal pump is relatively easy to handle and therefore is utilized in various fields there is another problem related to such structure. More particularly, the impeller rotates continuously and the fluid which has been introduced from the suction port is rotated and pressurized in the form of a vortex flow in the annular flow path, then is carried to the discharge port by the action of the partition wall. At this time, as, for example, disclosed in Japanese Utility Model Laid Open No. 91308/76, a portion of the fluid is allowed to remain between adjacent vanes of the impeller and is thereby conveyed to the suction portion side, which fluid portion will hereinafter be referred to as "carry-over flow". The carry-over flow passes the partition wall and is conveyed to the suction side while the rotation thereof is suppressed. On the suction side, the pressurized carry-over flow is released throughout the entire vane width and expands substantially uniformly in the flow path. As a result, the amount of fluid which is introduced decreases accordingly, that is, an effective amount of fluid conveyed decreases, and hence the characteristic thereof remains poor.

As mentioned above, the fluid of a large rotation and high pressure on the discharge port side flows out from the discharge port. But according to an analysis made by the present inventors, it turned out that the carry-over flow not only decreases an effective amount of fluid conveyed, but also operates disadvantageously in the following point. Once the carry-over flow of high pressure is released on the suction port side, it is released throughout the entire vane width in this position and expands substantially uniformly without rotation in the flow path. As a result, this expanded flow is mixed with fluid introduced from the suction port without changing the length of wetted perimeter and causes disturbance in the fluid introduced from the suction port. Due to this disturbance, the fluid introduced from the exterior through the suction port cannot form a rotating flow in the flow path portion near the suction port, and only after passing this mixing region, it forms an effective rotating flow. According to an experimental measurement made by the present inventors, this mixing region was about 40° in terms of the angle of circumference from the suction port to the discharge port side. In the conventional centrifugal pumps, therefore, a rotating flow cannot be formed at an angle corresponding to such mixing region, i.e., about 40°, so it is impossible to raise the pressure and hence the pressure is low. It became clear that this had a bad influence on the improvement of characteristics and also became clear that such disturbance badly affected the generation of noise.

It is a well-known fact that the disturbance of fluid causes the deterioration of performance also in hydraulics and aerodynamics.

SUMMARY OF THE INVENTION

It is an object of the present invention to provide a vortex flow blower having improved performance.

It is another object of the present invention to provide a vortex flow blower which is able to lower noise level and to obtain a high static pressure over the entire range of air volume.

It is a further object of the present invention to provide a vortex flow blower capable of forming a rotating flow more effectively throughout the entirety of a flow path.

It is still a further object of the present invention to provide a vortex flow blower capable of forming a rotating flow smoothly from the vicinity of a suction port.

It is yet another object of the present invention to provide a vortex flow blower capable of utilizing a carry-over flow more effectively.

It is a further object of the present invention to provide a vortex flow blower capable of diminishing an influent loss of fluid.

According to the present invention, a vortex flow blower such as a centrifugal pump includes an impeller and a casing which is provided with an inlet or suction port and an outlet or discharge port and houses the impeller, and has an annular groove provided between the suction port and the discharge port along the direction of rotation of the impeller, in a part facing to blades of the impeller in the casing, and the annular groove has the sectional area thereof reduced in a part of a zone extending between the discharge or outlet port and point midway between the inlet or suction port and the discharge or outlet port of the annular groove, thereby enabling noise reduction and high static pressure.

According to a feature of the present invention, a section of the annular groove to be reduced is cut on a plane passing a rotating shaft and formed of a slanting projection extending from the vicinity of the outer peripheral edge of the annular groove to the bottom of the annular groove.

In accordance with another feature of the present invention, the depth of the annular groove from the surface of casing facing the impeller increases in the order of an intermediate position between the central part of the annual passage and the suction port, the central part of the annual passage, and an intermediate position between the central part of the annular passage and the discharge port.

In accordance with the present invention, the impeller is driven to rotate by a primer mover, producing an internal flow of a fluid flowing out from the outer peripheral section, and the reduced area of the annular groove provides a slant face to the internal flow of the fluid flowing out from the impeller, guiding the fluid to the inner periphery so as to positively change the course of the internal flow. Therefore, the internal flow of fluid flowing out from the outer peripheral section of the impeller is guided to the inner peripheral section, flowing close to the flow of fluid flowing out from a portion spaced from the outer peripheral section of the impeller. In this manner, the occurrence of breakaway of the fluid which is likely to be caused by a difference in flow velocity between the fluid flowing out from the outer peripheral section of the impeller and the fluid flowing from the position spaced from the outer peripheral section is minimized, thereby enabling controlling occurrence of sound and, at the same time, controlling a loss resulting from internal flow turbulence. Thus it is possible to obtain a high static pressure. Furthermore, it is possible to control the occurrence of noise by guiding, in the vicinity of a no-discharge operation, the internal flow rapidly into the inner peripheral section and by decreasing the inflow velocity of the fluid at the inner peripheral section of the impeller and, at the same time, it is possible to control a loss resulting from the internal flow turbulence, thereby obtaining an increased static pressure. Additionally, it is possible to prevent a decrease in the air volume because the area of flow passage is kept unchanged on the suction or inlet side.

According to another feature of the present invention, the vortex flow blower such as a centrifugal pump is provided with an auxiliary flow supply path for supplying an auxiliary flow to fluid introduced from a suction or inlet port to conduct the fluid in a direction to form a rotating flow in a flow path.

In accordance with the present invention, the auxiliary flow may be fed from the exterior, but it is desirable and advantageous to utilize a carry-over flow. Furthermore, it is desirable that the auxiliary flow be supplied forwards relative to an advancing direction of an impeller, more specifically, at an angle in the range from 5° to 35°, using as a reference plane the surface of the partition wall of the flow passage which defines a very small gap with respect to the impeller.

In connection with utilizing a carry-over flow as the auxiliary flow, the present invention utilizes a discharge guide portion for guiding the carry-over flow so as to be discharged obliquely forwards relative to the advancing direction of the vanes of the impeller, on the suction or inlet port side of the partition wall. The partition wall is provided with a flow guide portion for conducting the flow from the suction port efficiently into the annular flow path. Fluid remaining between adjacent vanes is carried to the suction port side in a closed state of a discharge or outlet port by the flow guide portion. Although the discharge guide portion may be provided separately from the partition wall, it is desirable to form it in the flow guide portion of the partition wall. The portion of the partition wall where the flow guide portion is to be formed may be cut-out in the form of a hole or may be cut out sideways.

According to the present invention, when constituting the discharge guide portion in the flow guide portion of the partition wall for discharging the carry-over flow obliquely forwards relative to the advancing direction of the impeller, the position thereof and the angle of its surface positioned forward relative to the advancing direction of the impeller are particularly important. When the discharge guide portion is provided on the outer periphery side, it is desirable that an opening position on the side opposed to a vane of the impeller be on a more outer periphery side in the position opposed to the vane in a radial direction thereof, more preferably, that the opening position be outside a central part of the vane width in the radial direction, and still more preferably, it be on the outer periphery side 1/6 or more with respect to the central part of the vane in the radial direction of the vane. In the circumferential direction thereof, the opening position of the discharge guide portion on the side opposed to the vane is preferably determined so that a rear end of the flow guide portion of the partition wall is at a distance about 1.5 to 2.5 times the vane-vane spacing with respect to a front end thereof in the advancing direction of the impeller. Further, the angle of the surface positioned forward relative to the impeller advancing direction, which is important for the jet of the carry-over flow, is preferably in the range from 5° to 35° relative to the impeller advancing direction, using as a reference plane the surface of the partition wall which defines a very small gap with respect to the impeller.

When the discharge guide portion is provided on the inner periphery side, it is desirable that the opening position on the side opposed to the vane of the impeller be on a more inner periphery side in the position opposed to the vane, more preferably, that the opening position be inside a central part of the vane width in the radial direction, and still more preferably it be on the inner periphery side 1/6 or more with respect to the central part of the vane in the radial direction of the vane. In the circumferential direction thereof, the opening position of the discharge guide portion on the side opposed to the vane is preferably determined so that the rear end of the flow guide portion of the partition wall is at a distance about 1.5 to 2.5 times the vane-vane spacing with respect to the front end thereof in the advancing direction of the impeller. Further, the angle of the surface positioned forward relative to the impeller advancing direction, which is important for the jet of the carry-over flow, is preferably in the range from 5° to 35° relative to the impeller advancing direction, using as a reference plane the surface of the partition wall which defines a very small gap with respect to the impeller.

By supplying an auxiliary flow to the fluid introduced from the suction port for conducting the fluid in the direction to form a rotating flow in the flow path, as mentioned above, the fluid which is apt to be disturbed near the suction port is dragged by the auxiliary flow in an enlarged state of the wetted perimeter length and is conducted in the rotating direction. Therefore, the entirety of the flow path can be used more effectively and the fluid in the flow path is rotated and pressurized by a larger number of vanes, whereby it is made possible to raise the pressure and improve the performance. Moreover, since the disturbance of fluid on the suction port side can be diminished by the auxiliary flow, it is possible to suppress noise. Further, in the case where a carry-over flow is utilized as the auxiliary flow, the carry-over flow which constitutes disturbance can be operated on rotation effectively, whereby a further improvement of the performance can be attained.

These and further objects, features and advantages of the present invention will become more obvious from the following description when taken in connection with the accompanying drawings which show for purposes of illustration only, several embodiments in accordance with the present invention.

DETAILED DESCRIPTION OF THE PREFERRED EMBODIMENTS

Figure 1:
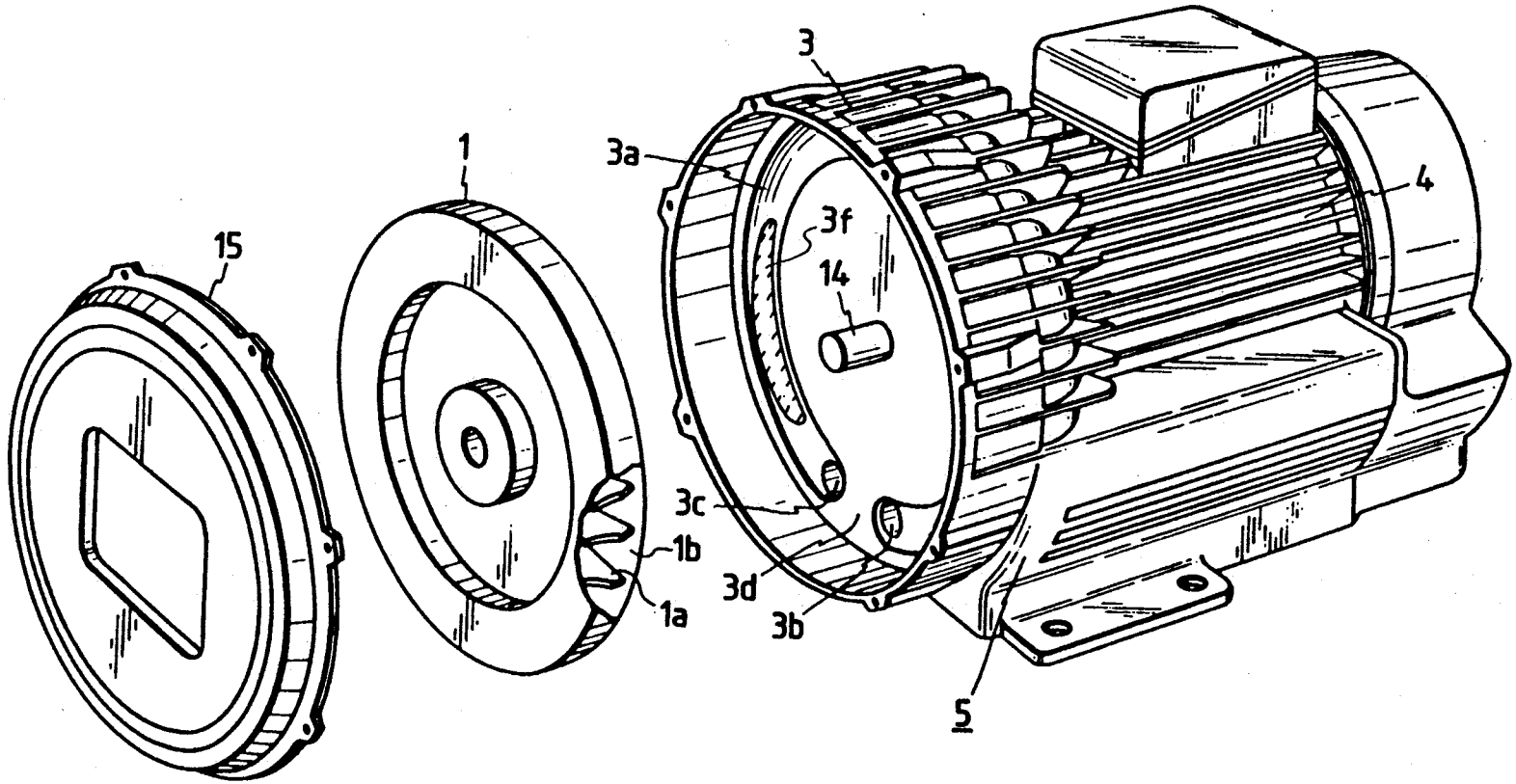
FIG. 1 is an exploded perspective view of a vortex flow blower such as a centrifugal pump according to the present invention.
Figure 5:
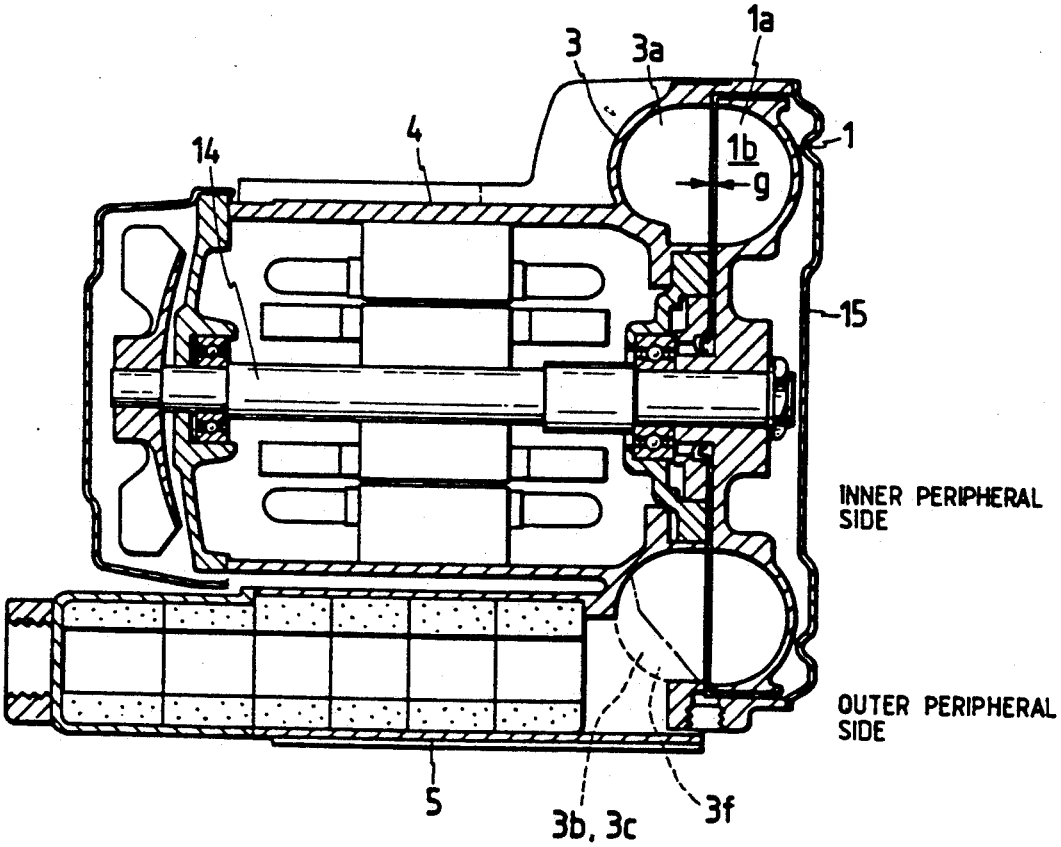
FIG. 5 is a longitudinal sectional view showing the general construction of the present embodiment.

Referring now to the drawings, FIGS. 1 and 5 illustrate a vortex flow blower such as a single-side impeller cup-type centrifugal pump having a plurality of vanes or vanes 1*a* in an annular groove 1*b* provided in an impeller 1. The impeller 1 is constructed to rotate on the center of a rotating shaft 14 driven by a prime mover 4. A casing 3 is provided with an inlet or suction port 3*b* and an outlet or discharge port 3*c*, and has a space for housing the impeller 1 inside. In the present embodiment, an induction motor is used as the prime mover 4. In a part of the casing 3 facing the blades or vanes 1*a* of the impeller 1, there is provided an annular groove 3*a* of the casing (hereinafter referred to as the annular groove 3*a*) which is extends from the suction port 3*b* to the discharge port 3*c* along the direction of rotation of the impeller 1, and which is open to the vanes 1*a*.

Figure 3A:
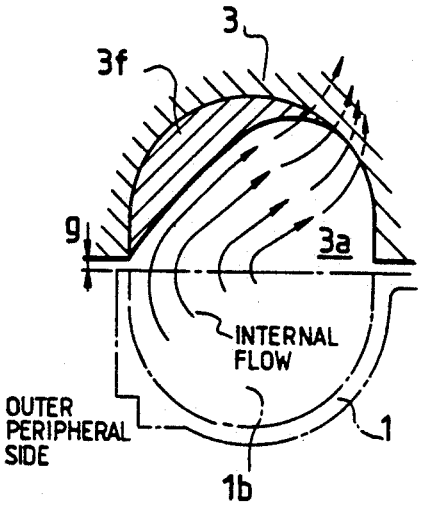
FIG. 3(A) is a sectional view of the passage of the present embodiment taken along line 3A—3A of FIG. 2 showing a sectional area reducer and FIG. 3(B) is a sectional view taken along line 3B—3B of FIG. 2.

The impeller 1 has a plurality of vanes 1*a* arranged so as to extend transversely to the annular groove 3*a* and the annular groove 1*b* of the impeller 1 (hereinafter referred to as the annular groove 1*b* of the impeller), which annular groove is disposed opposite to the annular groove 3*a* across a small gap g as shown in FIG. 3(A).

A part of the annular groove 3*a* on the circumference between the suction port 3*b* and the discharge port 3*c* is partitioned with a partition wall section 3*d*. The suction port 3*b* on the end side of rotation of the impeller 1 and the discharge port 3*c* on the start side of rotation of the impeller 1 are open at the bottom section of the annular groove 3*a* adjacent to the partition wall 3*d*. A sectional area reducer 3*f* is mounted for reducing a sectional area of the annular groove 3*a* in a part of zone extending from at least the discharge port 3*c* to a point midway o at the center (hereinafter referred to as the suction-discharge center 3*e*) of a portion of the annular groove 3*a* between the suction port 3*b* and the discharge port 3*c* as shown in FIG. 2.

Figure 2:
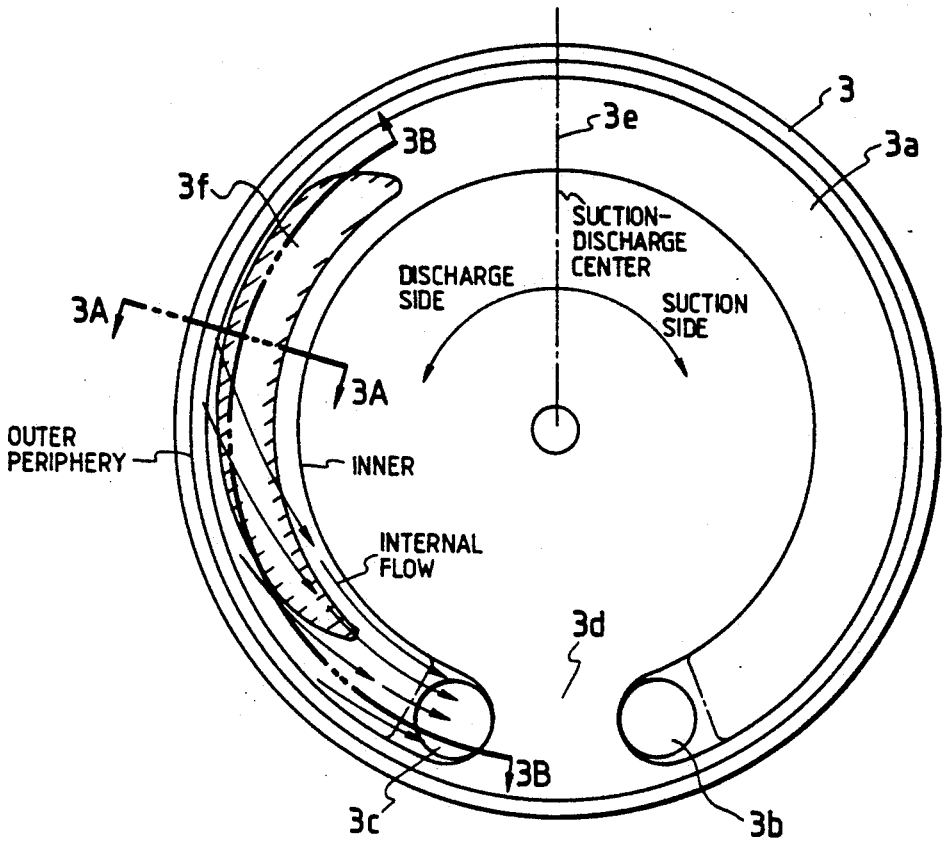
FIG. 2 is a plan view of a fluid passage of the centrifugal blower of FIG. 1.
Figure 3B:
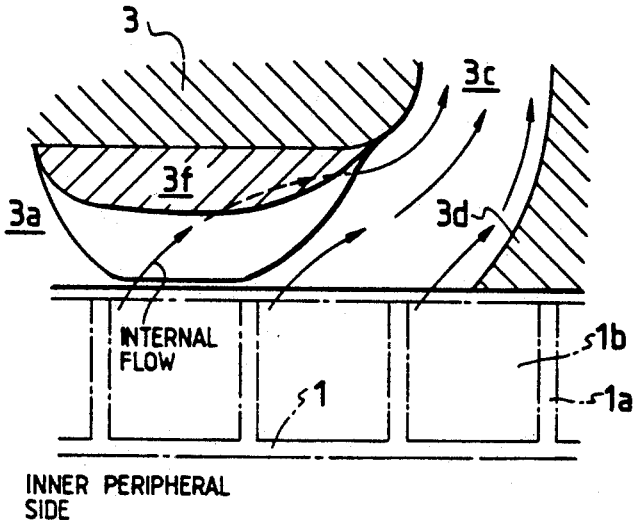
Figure 4:
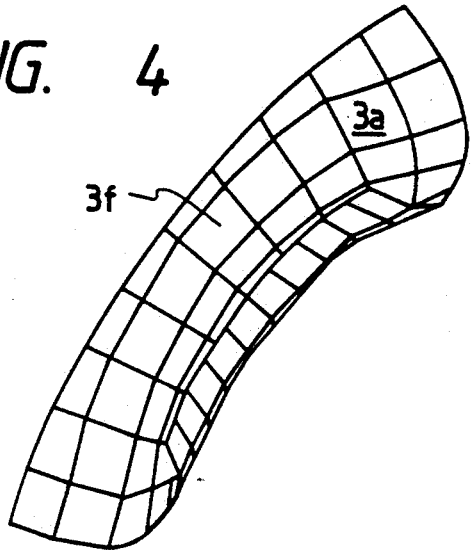
FIG. 4 is a view showing the sectional area reducer by ridge lines of the passage of the present embodiment.

The area reducer, in the present embodiment, is a reduced section 3*f* as shown in FIGS. 2–4 and represented as a section cut on a plane passing a rotating shaft which is formed of a slanting projection extending from the vicinity of the outer peripheral edge of the annular groove 3*a* (the vicinity of the small gap g from the periphery of the impeller 1) to the bottom of this annular groove 3*a*. The area reducer is disposed in a zone extending from the suction-discharge center 3*e* of the annular groove 3*a* to the center of the discharge port 3*c*, and more particularly in a 70-percent zone close to the suction-discharge center 3*e*, as shown in FIG. 2. In the present invention, there exists an angle of 160° between the suction-discharge center 3*e* and the discharge port 3*c*, and therefore the area reducer is disposed within a zone up to 112° from the suction-discharge center 3*e*. The maximum range of zone in which the area reducer is provided starts at the suction-discharge center 3*e*, arriving at a position at the angle of 112° along the annular groove in the direction of the discharge port, and the minimum range starts experimentally at a position at the angle of 30° along the annular groove in the direction of the discharge port from the suction discharge center 3*e* and arrives at a position at an angle of 90° from the suction discharge center 3*e*. The length of the zone of the area reducer corresponds to approximately 50 percent of the maximum value.

The area reducer may be provided at the discharge or suction port section as described in the copending U.S. patent application Ser. No. 760,347. In this case, on the outlet or discharge side, a part of the internal flow of fluid hitting on the partition wall 3*d* is restrained to a smooth flow and furthermore enables noise reduction, whereas on the inlet side, the internal flow is guided to pass the vicinity of the impeller 1, being substantially accelerated by the impeller 1 to thereby increase the air volume. In the present embodiment, the prime mover 4 turns the impeller 1 on the center of the rotating shaft 14 to produce an internal flow in the annular groove 3*a* and in the annular groove 1*b* of the impeller by the plurality of vanes 1*a* in the annular groove 1*b* of the impeller as shown in FIGS. 3(A) and 3(B). That is, the centrifugal pump of this invention is so constructed as to form the internal vortex flow of fluid whirling from the suction port 3*b* of the casing to the discharge port 3*c* through the suction-discharge center 3*e* and the area reducer 3*f*.

In the present embodiment, there is formed the internal flow including a primary flow substantially accelerated in the direction of rotation of the impeller 1 from the suction port 3*b* to the middle 3*c* between the suction and discharge sides and a secondary flow whirling in the annular passages 1*b* and 3*a*, the internal flow flowing smoothly without breakaway by flowing through the area reduced section 3*f* of a configuration exaggeratively shown by ridge lines in FIG. 4 from the middle 3*e* between the suction and discharge sides to the discharge port 3*c*. Thus, it is possible to prevent the occurrence of turbulence resulting from breakaway and accordingly to prevent the occurrence of noise and pressure loss.

Figure 6:
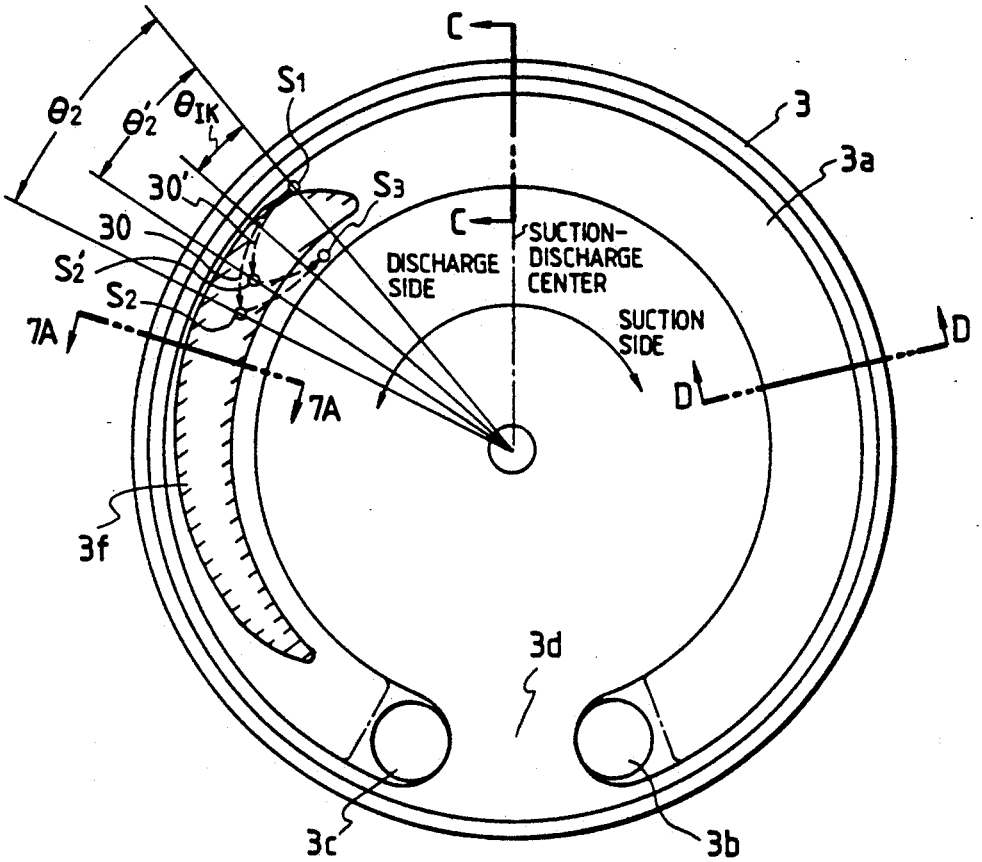
FIG. 6 is a plan view showing air stream in the passage of embodiment of FIG. 2.
Figure 7A:
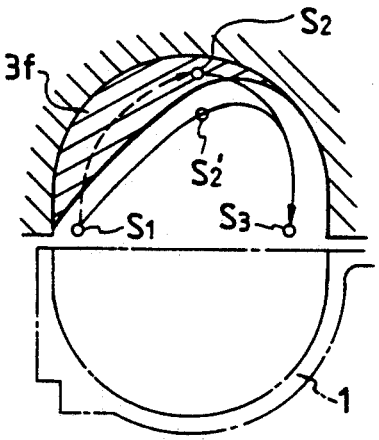
FIG. 7(A) is a sectional view showing an internal flow in the passage of the embodiment of FIG. 6 taken along line 7A—7A and FIG. 7(B) illustrates the distribution of circumferential internal flow.
Figure 7B:
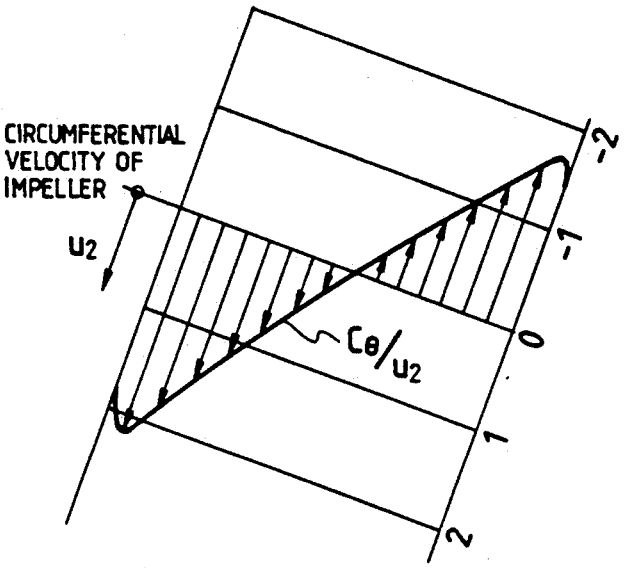
Figure 8:
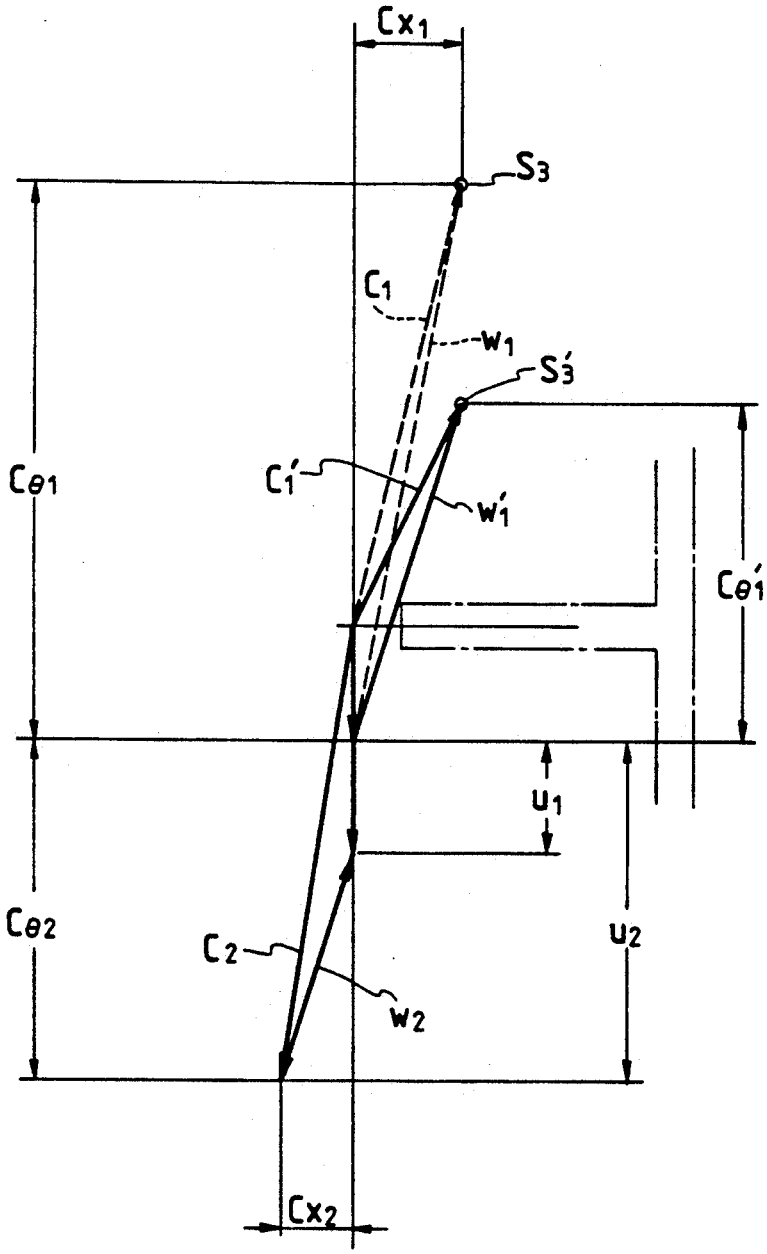
FIG. 8 is a velocity triangle of the internal flow of FIG. 6.

The internal flow in the vicinity of a no discharge operation where, for example, the discharge outlet is blocked, will become as shown in FIGS. 6 to 8. In this case, the internal flow is rapidly guided to the inner periphery via the area reduced section 3*f* of the configuration exaggeratively shown by the ridge lines in FIG. 4 to thereby decrease the inflow velocity of the internal flow in the inner peripheral section of the impeller and to restrain noise occurrence and, at the same time, a loss likely to be caused by internal flow turbulence, thus obtaining an increased static pressure. The internal flow 30, as shown in FIG. 6, flows from the point S2 on the outer periphery of the impeller 1, flowing at a high rate into the annular groove 3*a* of the casing as far as the point S2 in the direction of rotation of the impeller 1 on the outer periphery of the annular groove 3*a*. This flow does not flow to the discharge port 3*c*, but the fluid flows in a reverse direction of rotation on the inner periphery of the annular groove 3*a* and returns to the point S3 near the original outflow point S1 so that only an effective part of outflowing fluid in the annular groove 3*a* will flow. That is, the flow of the fluid on the outer and inner peripheries becomes as follows:

Outer periphery side of casing: S1 ⟶ S2 (the fluid flows for the angle of advance $\theta 2$ in the direction of rotation)

Inner periphery side of casing: S2 ⟶ S3 (the fluid flows for the angle of return $\theta 2'$ in a reverse direction of rotation)

That is, the fluid flowing out at the point S1 on the outer periphery of the impeller 1 does not return to the point S1 when returning to the inner periphery of the impeller 1, but returns in the direction of rotation to the point S3 which has advanced by the carry-over flow rate QIK.

If the passage in the annular groove 3*a* has a semicircular cross section, the fluid increased by a quantity corresponding to the angle of advance θ2 flows from the point S1 to the point S2 on the outer periphery of the annular groove 3*a*, and also the fluid increased by a quantity corresponding to the return angle of θ2' returns from the point S2 back to the point S3 on the inner periphery of the annular groove 3*a*, and therefore the fluid from the point S3 flows into the impeller at a flow velocity w1 as shown in FIG. 8. Noise occurring in the no discharge operation of the centrifugal blower is largely attributable to a turbulence accompanying the inflow of fluid on the inner periphery of the impeller. A measured value of the internal flow indicates that the blower has the drawback that there occurs large noise and turbulence of flow when the fluid flows into the impeller because the flow velocity w1 is about twice as great as u2 which is the peripheral velocity of the impeller.

Figure 10:
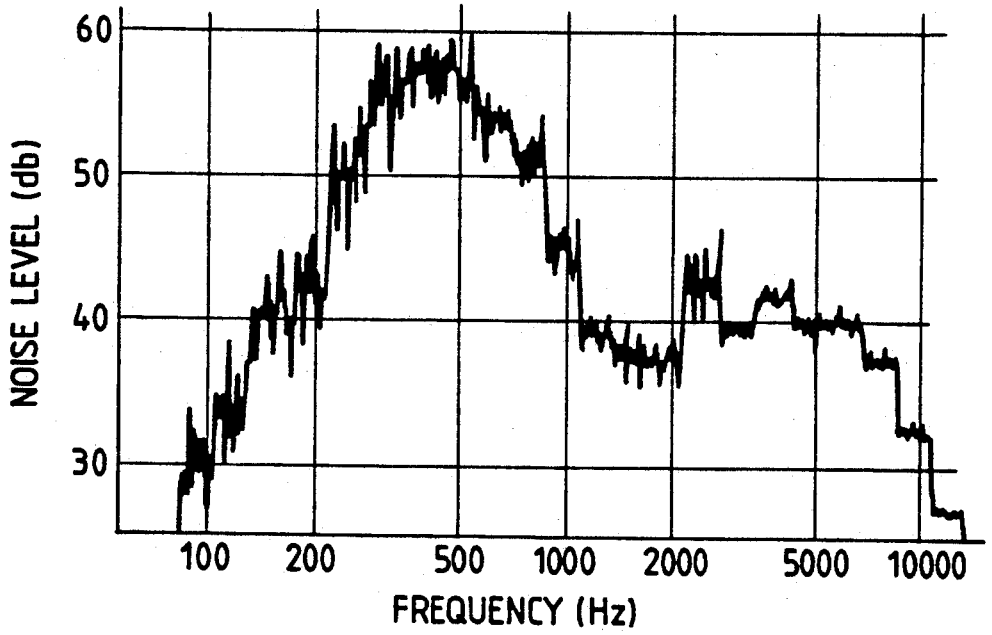
FIG. 10 PRIOR ART
FIG. 10 illustrates a noise spectrum in accordance with a conventional centrifugal pump.

Measurements of the internal flow of, for example, a centrifugal blower using an impeller of 210 mm diameter D2 and turning at a speed of 2850 rpm indicate that the peripheral velocity u2 of the impeller is 31.3 m/s, the flow velocity C2 at a no discharge operation is 78.5 m/s (C2 makes no difference between the presence and absence of the area reducer 3*f* in the casing), the flow velocity C1 is 6.5 m/s, and the flow velocity w1 is 93.5 m/s, and further that, as shown in FIG. 10, a frequency component (fluid noise) at 200 to 1000 Hz and a frequency component (siren sound) at around 2000 Hz are large, and an overall noise level is 63 db as obtained in a conventional centrifugal blower. According to the present embodiment, the flow can be changed from 30 to 30' as shown in FIG. 6, and the length of circular arcs S1 and S2 can be made shorter as compared with conventional ones by reducing the area of passage on the outer periphery of the annular groove 3*a* so as not to use the annular groove 3*a* of semicircular cross section as shown in FIG. 7(A). Therefore, the angle of advance of the fluid flow in the direction of rotation of the impeller also largely decreases from conventional θ2 to θ2'.

With the decrease in the angle of advance of the fluid flow on the outer periphery of the annular groove 3*a*, the angle of return of fluid flow from the point S2 to the point S3 on the inner periphery of the annular groove 3*a* also decreases. Therefore, the inflow velocity of fluid into the impeller becomes w1', much smaller than conventional w1, as shown in FIG. 8.

Figure 9:
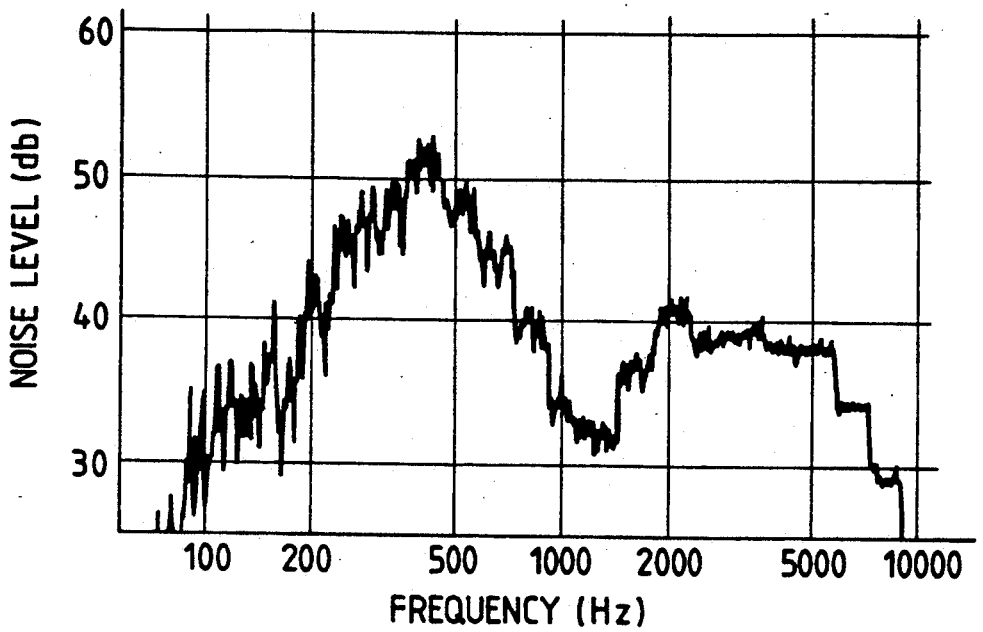
FIG. 9 illustrates a noise spectrum in accordance with an embodiment of the present invention.

When the impeller diameter D2 is 210 mm, the inflow velocity w1' of fluid flowing into the impeller in the present embodiment becomes 65.2 mm, considerably smaller than the conventional w1 of 93.5 m/s. In consequence, a turbulence arising with the inflow of fluid flowing into the impeller largely decreases also, and the frequency component in the vicinity of 200 to 1000 Hz and 2000 Hz attenuates, with a result that an overall noise level decreases as low as 56 db as shown in FIG. 9, which is 7 db lower than that provided by the construction of the vortex flow blower as described in the copending U.S. patent application Ser. No. 760,347. Furthermore, the power requirement for the blower are decreased by about 20 percent or greater by lessening the turbulence.

In the present embodiment, as described above, the annular groove in the casing of the cup-type centrifugal pump has, on its outer periphery, an area reducer for reducing a sectional area by a slant face which starts at the vicinity of a small gap on the outer periphery, and positively guides along the slant face the internal flow of fluid flowing out from the outer periphery of the impeller to the inner periphery, thereby preventing breakaway of flow in order to insure noise reduction and high static pressure. Therefore, the present invention has such advantages that the noise level can be lowered as low as about 7 dB, that is, a noise energy produced can be diminished to 20 percent, and, at the sane time, that the pressure can be increased by about 10 percent. Generally, the area reducer is formed as an integral part of the annular groove. However, the area reducer 3*f* may also be made of a member different from the casing and attached in the annular groove 3*a*, and may be so constituted as to guide the internal flow to the inner periphery along the slant face of this different member. The casing is generally produced of an aluminum die casting, but the area reducer 3*f* may be formed of a steel, ceramic, or fluoroplastic material.

As shown in FIG. 3(A), for example, producing the area reducer 3*f* as a member different from the annular groove 3*a* can optimize the configuration, enabling the use of abrasion- and corrosion-resistant materials and also facilitating the replacement of the area reducer 3*f*. Therefore, it is possible to maintain the area reducer 3*f* in good condition even in a centrifugal pump which is exposed to twice as high an internal flow velocity as the peripheral velocity.

Figure 11:
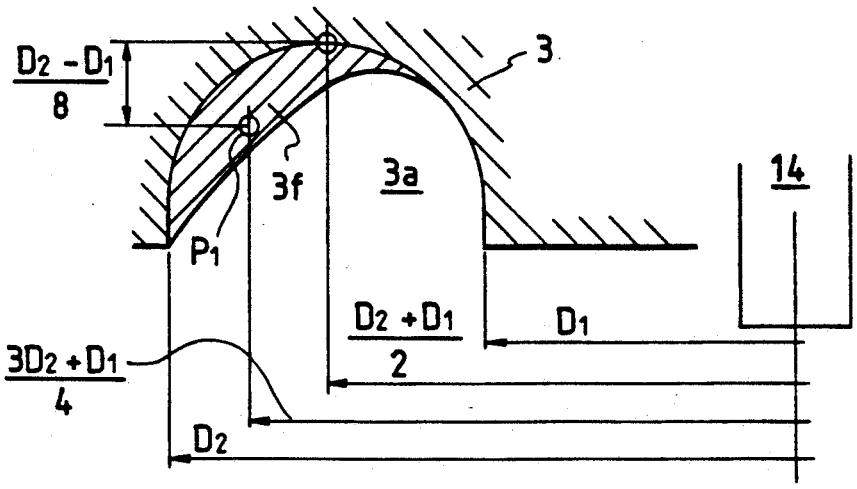
FIG. 11 is a sectional view of a passage and sectional area reducer of another embodiment of the present invention.

Another embodiment of the present invention will be described with reference to FIGS. 11 to 15, wherein a position considered to be approximately at the center of the slant face of the area reducer 3*f* is specified, so that the function of the slant face will be more effectively performed. In the present embodiment, of a 70 percent part of the zone close to the suction-discharge center 3*e*, the zone extending from at least the suction-discharge center 3*e* of the annular groove 3*a* formed between the suction port 3*b* and the discharge port 3*c* to the center of the discharge port 3*c*, the area reducer 3*f* is constructed such that, as shown in FIG. 11, a point P1 beneath the passage surface of the area reducer 3*f* (the surface position of the slant) in the diameter of (3D2+D1)/4 in the annular groove 3*a* will be at a distance (D2−D1)/8 from the bottom face of the annular groove 3*a* in the center diameter (D2+D1)/2 in the annular groove 3*a* when no area reducer 3*f* is present in the annular groove. In the above description, D1 and D2 are the inner and outer peripheral diameters of the annular groove 3*a*, respectively, as measured from the center of the rotating shaft 14. In the present embodiment, there exists an angle of 160° between the suction-discharge center 3*e* to the center of the discharge port 3*c*. Therefore, the depth of the annular groove having the above-described relationship becomes shallow in the zone ranging from the suction-discharge center 3*e* to 112°. This zone may extend to a 70-percent part close to the suction-discharge center 3*e* of the zone extending from the suction-discharge center 3*e* to the center of the discharge port 3*b* as necessitated.

On the discharge or outlet side from the suction-discharge center 3*e*, the components of the internal flow grow more in a circumferential direction than those in a direction of rotation. Therefore, a countermeasure for noise reduction is sufficient if performed mainly on the components of the internal flow in a circumferential direction. To reduce noise resulting from a turbulent flow, it is imperative to prevent breakaway of flow on the outer periphery. A conceivable method of preventing this breakaway is to decrease the sectional area of the annular groove, but when the sectional area is only decreased, the low passage will become too narrow, resulting in a decreased gas or air volume.

In the present embodiment, the sectional area can be insured and accordingly a specific air volume can be maintained on the inner periphery by providing the area reducer 3*f* on the outer periphery as previously stated. It is possible to effectively prevent the air flow breakaway and to control a loss likely to be caused by an internal flow turbulence so as to increase the static pressure by providing the area reducer.

Figure 12:
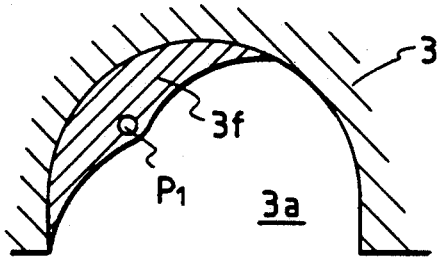
FIG. 12 is a sectional view of a passage and sectional area reducer of a variation of the embodiment of FIG. 11.

FIG. 12 illustrates a variation of the present embodiment wherein the intermediate position of the area reducer 3*f* is shallower than the position P1 used as a reference position in FIG. 11, for more effective use of the area reducer 3*f* of the annular groove 3*a*.

Figure 13:
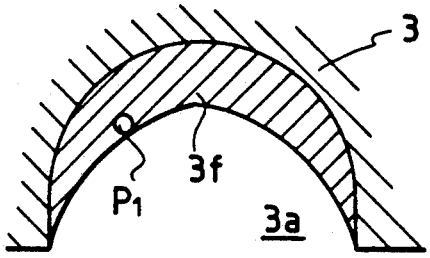
FIG. 13 is a sectional view of a passage and sectional area reducer of another variation of the embodiment of FIG. 11.

FIG. 13 illustrates another variation of the present embodiment wherein the area reducer 3*f* is provided in a part extending from the inner and outer peripheral edges of the annular groove 3*a* toward the bottom face of the annular groove. In this variation, the relationship with respect to the depth of the annular groove at the position P1 is the same as that shown in FIG. 11.

Figure 14:
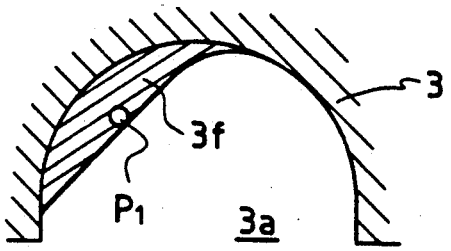
FIG. 14 is a sectional view of a passage and sectional area reducer of a further variation of the embodiment of FIG. 11.

FIG. 14 illustrates a further variation of the present embodiment wherein the area reducer 3*f* is formed of a slanting projection which starts, with a slight clearance provided, from the vicinity of a position (edge) with a small gap formed between the outer periphery of the impeller 1 and the outer periphery of the annular groove 3*a*, to the bottom face of the annular groove 3*a*. The area reducer 3*f* of the annular groove 3*a* is set with some clearance provided from the outer peripheral edge of the annular groove to leave some perpendicular section on the outer peripheral side, thus facilitating the positioning of the impeller.

Figure 15:
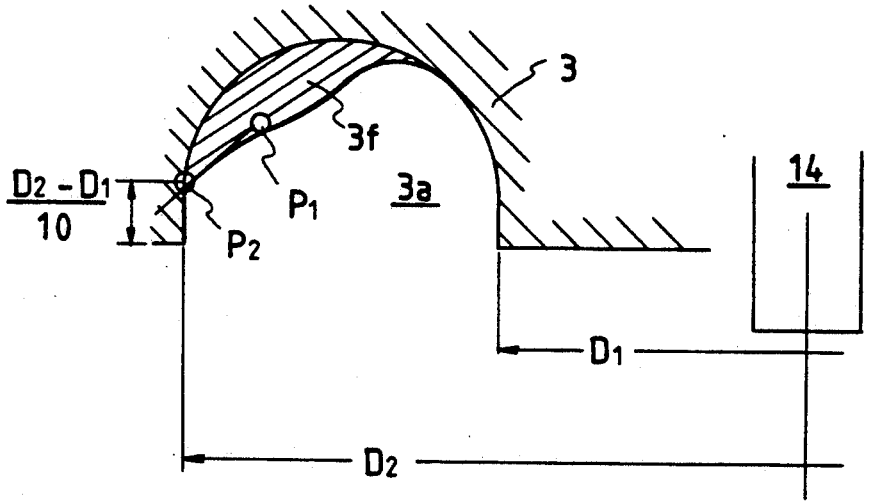
FIG. 15 is a sectional view of a passage and sectional area reducer of another variation of the embodiment of FIG. 11.

FIG. 15 illustrates another variation of the present embodiment wherein the outer peripheral position of the area reducer 3*f* of the annular groove 3*a* is set shallower than the position P1 used as a reference position in FIG. 14, for the purpose of effective use of the area reducer 3*f*. In this variation, the area reducer 3*f* is so constructed that the depth, from the small gap face at D2, of a tangent between the point P1 in the diameter (3D2+D1)/4 of the annular groove 3*a* and a curve indicating the shape of a passage extending from the diameter (3D2+D1)/4 of the annular groove 3*a* in the same cross section to D2 will become less than (D2−D1)/10.

Figure 16:
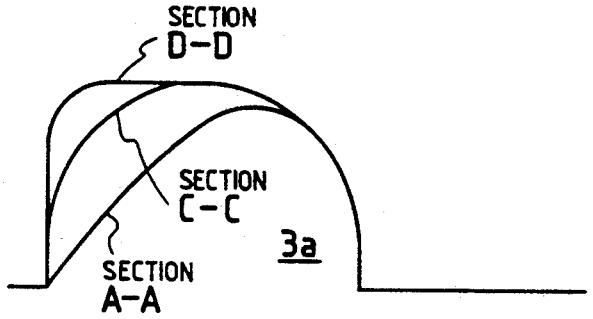
FIG. 16 is a sectional view of a passage and sectional area reducer of a further embodiment of the present invention.

A further embodiment of the centrifugal pump according to the present invention will be described with reference to FIG. 16, wherein the centrifugal pump also includes the impeller 1 and the casing 3 which has the suction port 3*b* and the discharge port 3*c* and houses the impeller 1 therein. In a part facing the vanes 1*a* of the impeller in the casing 3, the annular groove 3*a* is formed along the direction of rotation of the impeller 1, extending from the suction port 3*b* to the discharge port 3*c* and opening to the vanes 1*a*. In this centrifugal pump, the area reducer 3*f* for reducing the sectional area in the annular groove 3*a* is provided in a part of the zone extending from at least the middle or midpoint 3*e* of a part of the annular groove 3*a* between the suction port 3*b* and the discharge port 3*c* and the center of the discharge port 3*c*. The depth of the annular groove 3*a* from the surface of the casing 3 facing the impeller 1 increases in the order of an intermediate position between the middle 3*e* of the annular groove 3*a* and FIG. 16 shows cross sections of the annular groove at the positions A—A, C—C and D—D in the circumferential direction, in which order the depth of the annular groove increases. In the present embodiment, the use of the area reducer 3*f* can lower the noise level and obtain a high static pressure even within a range of large air volume and furthermore a specific air volume is obtainable because of a wide section D—D.

Figure 17A:
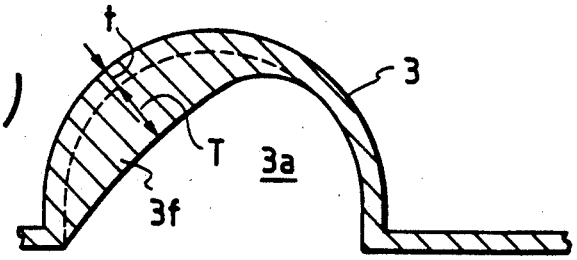
FIG. 17(A) is a sectional view of a passage and sectional area reducer of another embodiment of the present invention and FIG. 17(B) is a sectional view of a passage and sectional area reducer of a variation of the embodiment of FIG. 17(B)
Figure 17B:
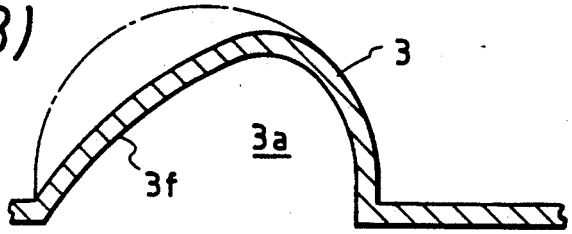
Figure 18:
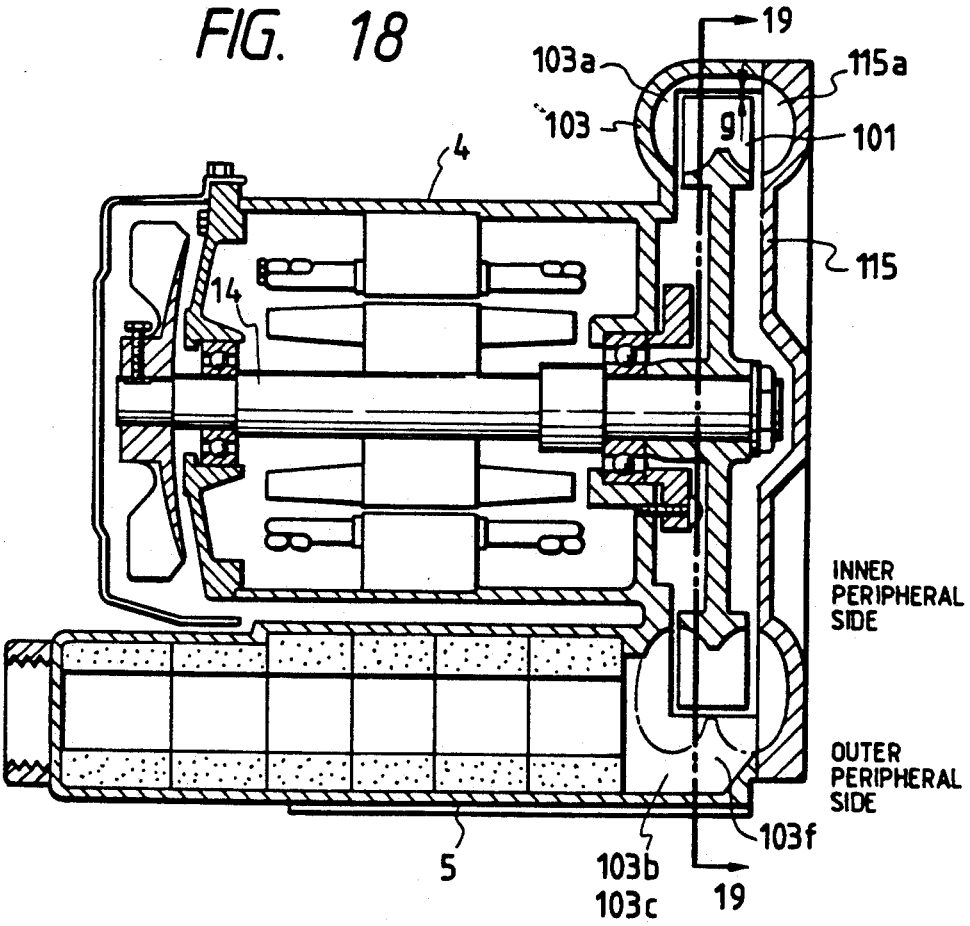
FIG. 18 is a longitudinal sectional view of a further embodiment of the present invention utilizing a double-sided impeller.

Another embodiment of the present invention will be described with reference to FIGS. 17(A) and 17(B). In the present embodiment, the slant of the annular groove 3*a* is produced of the same member as the casing 3 and the inner surface of the annular groove 3*a* is made in a slanting form protruding toward the inside of the annular groove within the range of slant formation of the casing, thereby providing the area reducer 3*f*. As shown in FIG. 17(A), the wall thickness T at the maximum thickness of the casing 3, within the range of slant formation, is two times larger than the wall thickness t of a part where no slant is formed in the same circumference. Using a casing with a thick-wall section as illustrated in FIG. 17(A) for forming the area reducer 3*f* can prevent occurrence of a problem if the casing becomes worn, and also enables high-rate manufacture of a quality device by using a mold cut to a desired form and also enables increasing durability by increasing the wall thickness of the casing. FIG. 17(B) illustrates a variation of the present embodiment wherein the casing as a member of the annular groove 3*a* is formed into a slant face swelling toward the inside of the annular groove 3*a* without changing the plate thickness, thereby saving material and reducing the weight of the centrifugal pump. In the centrifugal pump, the maximum velocity of the internal flow is generally twice as high as the peripheral speed of the impeller. Because of such high velocity flow, the above-described consideration is needed. In the embodiments described above, the annular groove of a shape applicable to the single-side cup-type centrifugal pump has been described, but it is also possible to adapt the annular groove with a sectional area reducer to the double-side blade-type centrifugal pump.

A further embodiment of the centrifugal pump, according to the present invention, will be described with reference to FIGS. 18 to 22 in relation to a double-side vane-type centrifugal pump. The basic construction of said centrifugal pump will be explained with reference to FIGS. 18 to 20(A) and 20(B). The present embodiment of the double-side vane-type centrifugal pump provides for sectional area reduction by a slant face sloping toward the side of the impeller from the vicinity of a small gap, on the outer peripheral side of the annular groove in the casing, and positively guides the internal flow of fluid flowing out from the outer periphery of the impeller to the discharge port or to the inner periphery of the impeller along the slant face.

The double-side vane-type centrifugal pump of the present embodiment comprises a double-side vane-type impeller 101 having on its outer periphery a number of vanes 101*a* protruding nearly radially in relation to a rotating shaft, a casing 103 having an annular groove 103*a* on the side and outer peripheral side correspondingly to the vanes 101*a* of the impeller 101 facing thereto, a side cover 115 having an annular groove 115*a* which opens on the side and outer peripheral side correspondingly to the vanes 101*a* of the impeller 101 facing thereto, a partition wall section 103*d* which separates a part on the circumference of the annular groove 101*a* of the casing, a suction port 103*b* located adjacently to the partition wall section 103*d* of the casing and open in the axial side of the impeller 101, and a discharge port 103*c* located adjacent to the partition wall section 103*d* of the casing and open to the side facing to the rotating impeller. In this centrifugal pump, an area reducer 103*f* for reducing the sectional area in the annular groove 103*a* is provided in a part of a zone extending from at least the middle of the annular groove 103*a* between the suction port 103*b* and the discharge port 103*c* to the discharge port 103*c*.

In the present embodiment the double sided vane-type impeller 101 is driven by the prime mover, producing an internal flow as in the cup-type centrifugal pump. In this case, there is formed the internal flow consisting of a primary flow fully accelerated in the direction of rotation of the impeller 101 from the suction port 103*b* to the suction-discharge center 103*e* and a secondary flow whirling in vanes 101*a* and the annular passage 103*a*. The internal flow subsequently smoothly flows from the suction discharge center 103*e* to the discharge port 103*c* via the area reducer 103*f* without a breakaway of flow.

Figure 19:
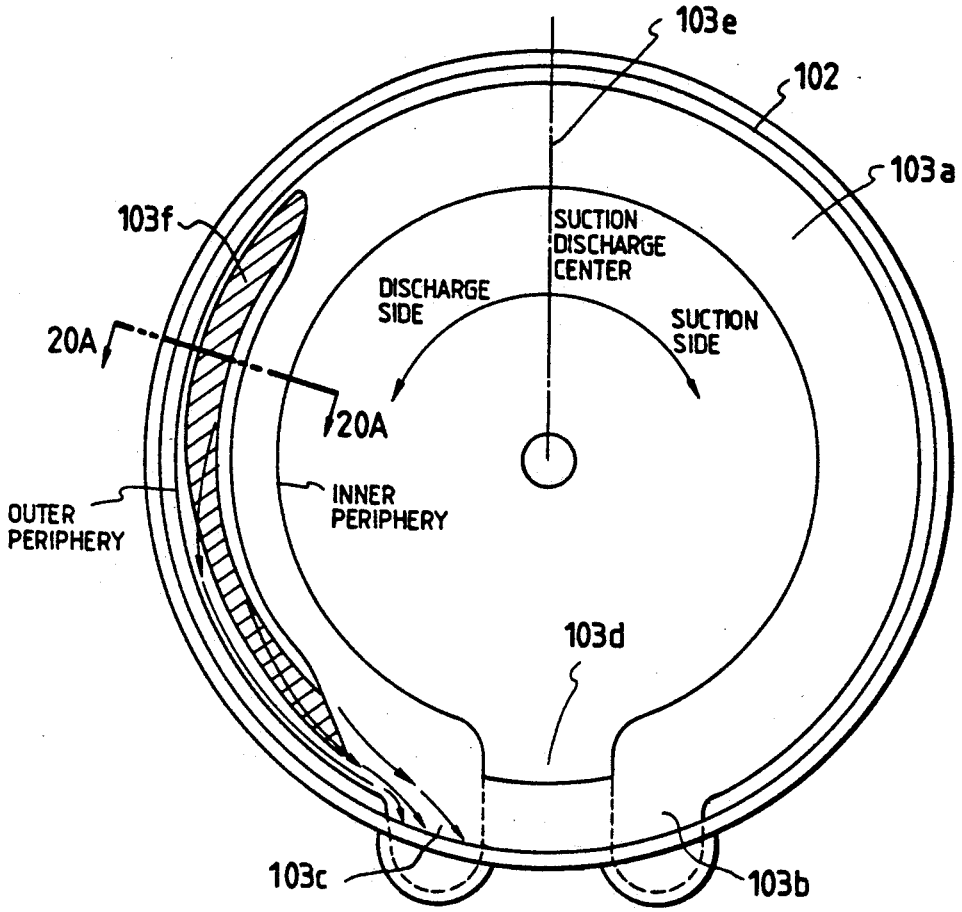
FIG. 19 is a plan view of a passage of the embodiment of FIG. 18.
Figure 20A:
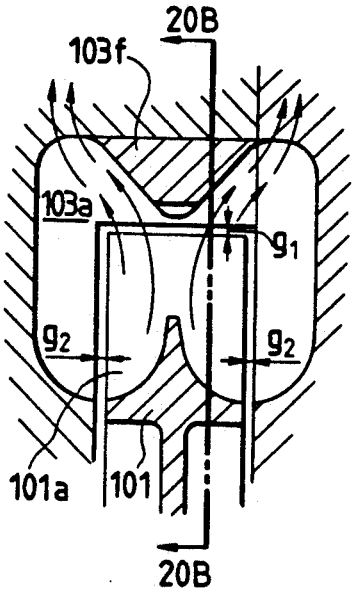
FIG. 20(A) is a sectional view of a passage taken along line 20A—20A of FIG. 19.
Figure 20B:
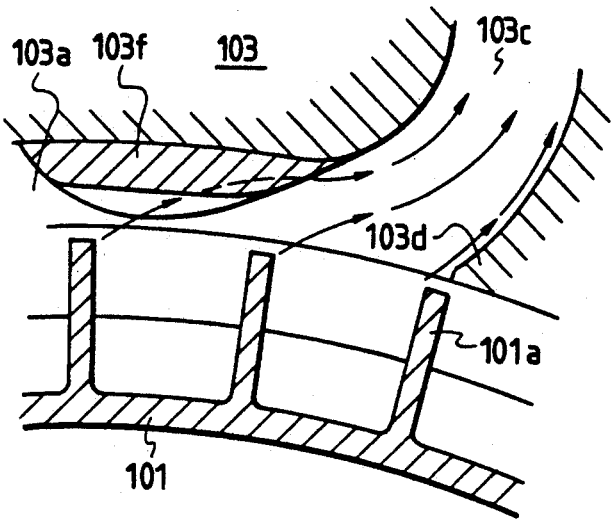
FIG. 20(B) is a sectional view taken along line 20B—20B of FIG. 19.

FIGS. 19 and 20(A) and 20(B) show the basic operation of the double-side vane-type centrifugal pump of the present embodiment. The fluid flowing out from the center of the outer peripheral section of the impeller 101 is guided toward the annular groove 103*a* side through the area reducer 103*f* formed by a slanted portion. The internal flow flows out at a position slightly shifted from the center of the outer periphery of the impeller, being guided toward the annular groove 103*a*, close to the internal flow from the center of the outer periphery of the impeller. Therefore, there occurs little breakaway of flow occurs despite the difference in flow velocity between the fluid flowing out from the center of the outer periphery of the impeller in a conventional centrifugal pump and the fluid flowing out from a position shifted from the center of the outer periphery of the impeller, thereby obtaining a high static pressure by controlling the occurrence of sound and at the same time a loss resulting from the internal flow turbulence. According to the present embodiment, therefore, it is possible to lower the noise level and to increase the static pressure of the double-side blade-type centrifugal pump.

The slant face as the area reducer is formed so that when D1 is the diameter at the gap face in the radial direction on the outer peripheral side of the annular groove 103*a* of the casing, D2 is the maximum diameter on the outer peripheral side of the annular groove 103*a* of the casing, g2 is a side gap, and B is the width across faces, the depth of the passage surface in the diameter (D2+D1)/2 of the annular groove of the casing, in a 70-percent part close to the suction-discharge center of the zone extending from the suction-discharge center on the outer periphery of the annular groove of the casing to the center of the suction port and in a 70-percent part close to the middle between the suction and discharge sides of the zone ranging from the suction-discharge center to the center of the discharge port will be over (D2−D1)/8 shallower than the maximum value of a radial depth on the outer peripheral side of the annular groove at the surface of the side gap g2.

The area reducer 103*f* for reducing the sectional area of the annular groove by the use of a slant face may be a separate member attached as shown in FIG. 20(A) and 20(B), which guides the internal flow toward the impeller along the slant face thereof and to the discharge port or the inner periphery of the impeller.

Figure 21:
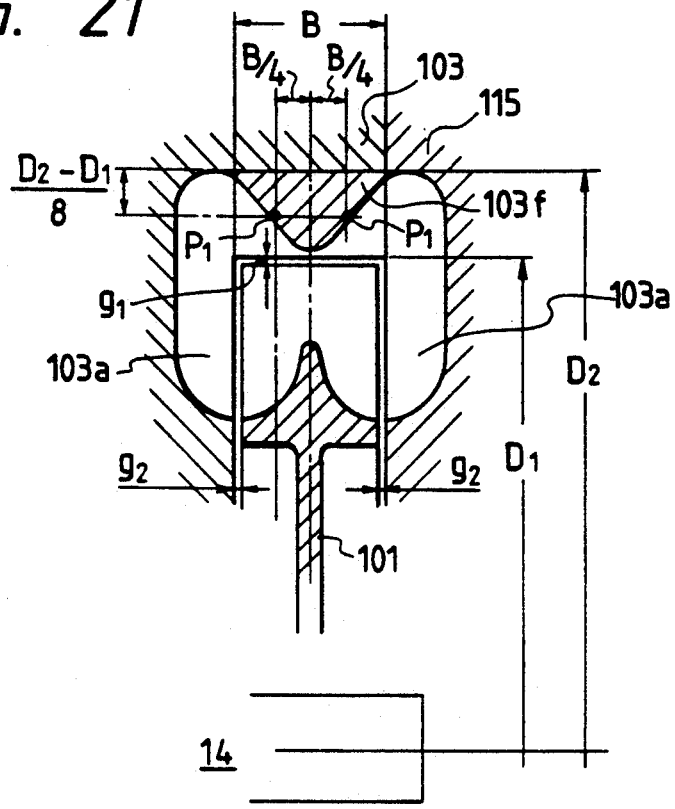
FIG. 21 is a sectional view of a passage of a variation of the embodiment of FIG. 19.

A variation of the present embodiment will be described with reference to FIG. 21 wherein the area reducer of the annular groove of the casing is formed of a slant face sloping sideward, starting at a position specified on the slant face, with some gap provided in the vicinity of the small gap g1, in order that the function of this slant face will be effectively effected. In this variation, as shown in FIG. 21, the area reducer 103*f* of the annular groove 13*a* is provided in the vicinity of, and with some clearance provided from, the gap g1 on the outer peripheral side of the annular groove 103*a* of the casing. This clearance is usable as a reference for positioning the impeller.

Figure 22:
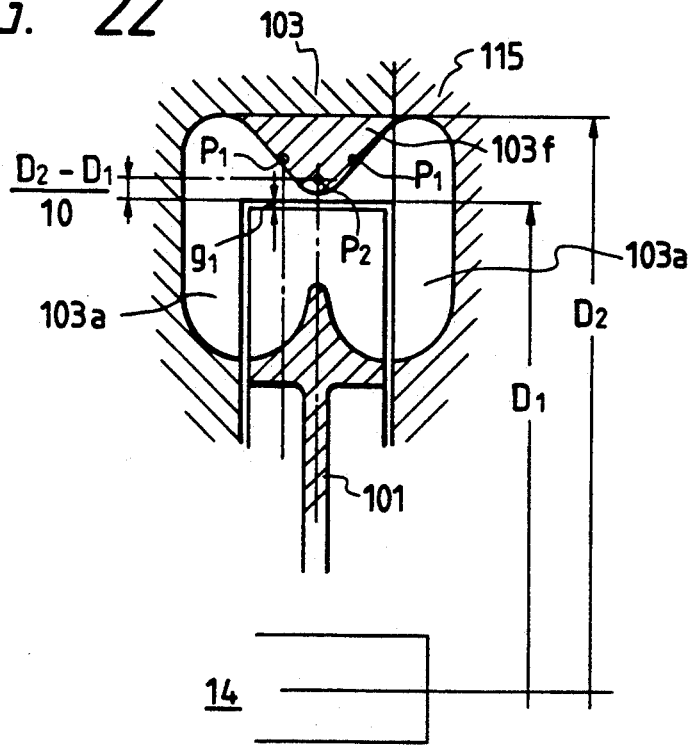
FIG. 22 is a sectional view of a passage of another variation of the embodiment of FIG. 19.

Another variation of the present embodiment will be described with reference to FIG. 22 wherein the intermediate position of the area reducer 103*f* of the annular groove 103*a* is set shallower than the position P1 used as a reference position in the first variation, for the purpose of effective use of the area reducer 103*f*. Further in this variation, as shown in FIG. 22, the depth from the small gap face g1 to P1 at the center of width on the outer periphery of the annular groove 103*a* of the casing is set so as to be (D2 - D1)/10 or less, to thereby decrease the sectional area of the annular groove 103*a*, thus improving the effect of leading the air flow into the inner peripheral side.

As a further variation of the present embodiment, the depth of the annular groove from the small gap face of the casing on the outer peripheral side of the casing 103 may be increased (not illustrated) in the order of an intermediate position between the middle 103*e* between the suction and discharge sides and the suction port 103*b* of the casing, the middle 103*e* between the suction and discharge sides, and an intermediate position between the suction-discharge center 103*e* and the discharge port 103*c*. In this variation, on the suction side in the circumferential direction, no slant face is provided on the outer peripheral side of the annular groove of the casing, with a large air volume characteristics taken into consideration, so that the fluid flowing out of the outer periphery of the impeller will flow along the outer periphery, and that the flow will not cross the flow being drawn into the suction port. Further, according to this variation, the maximum air volume can be increased by about 20 percent as compared with the volume of air flowing in the annular groove whose sectional area continues unchanged at a specific value from the suction port to the suction discharge center. Furthermore, in this variation, the thickness of the casing within the range of slant formation has been increased two times as large as the other part, thus increasing the thickness of the slant portion 103*f* to thereby prevent damage to the casing 103, such as a hole, resulting from abrasion by a high-velocity stream of fluid from the impeller 101

According to the described embodiments of the present invention, the breakaway of the internal flow can be prevented by providing the annular groove sectional area reducer, thereby enabling lowering the noise level and increasing the static pressure throughout the range of air volume.

Figure 23:
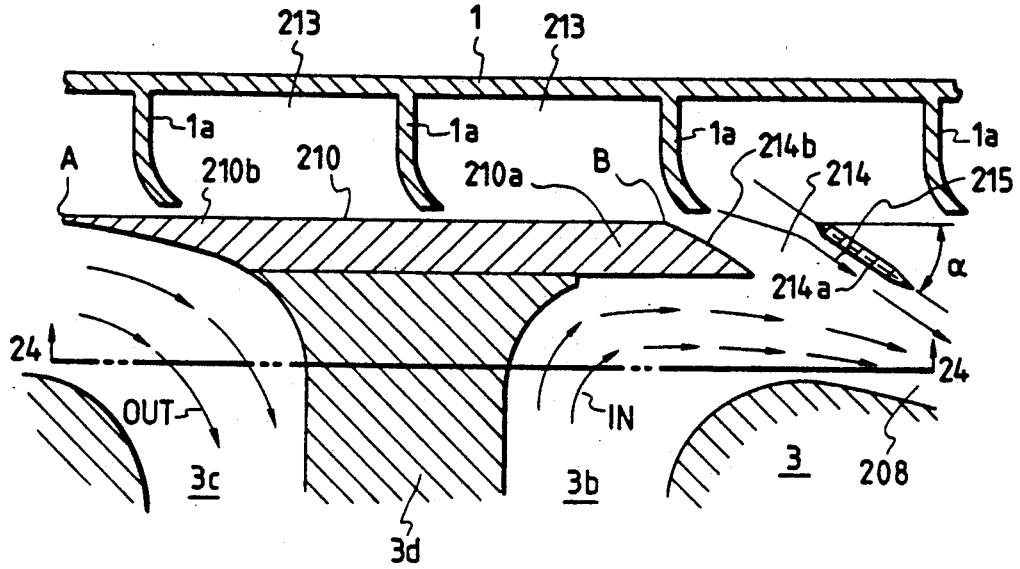
FIG. 23 is a sectional view of a principal portion of a centrifugal blower according to another embodiment of the present invention.
Figure 24:
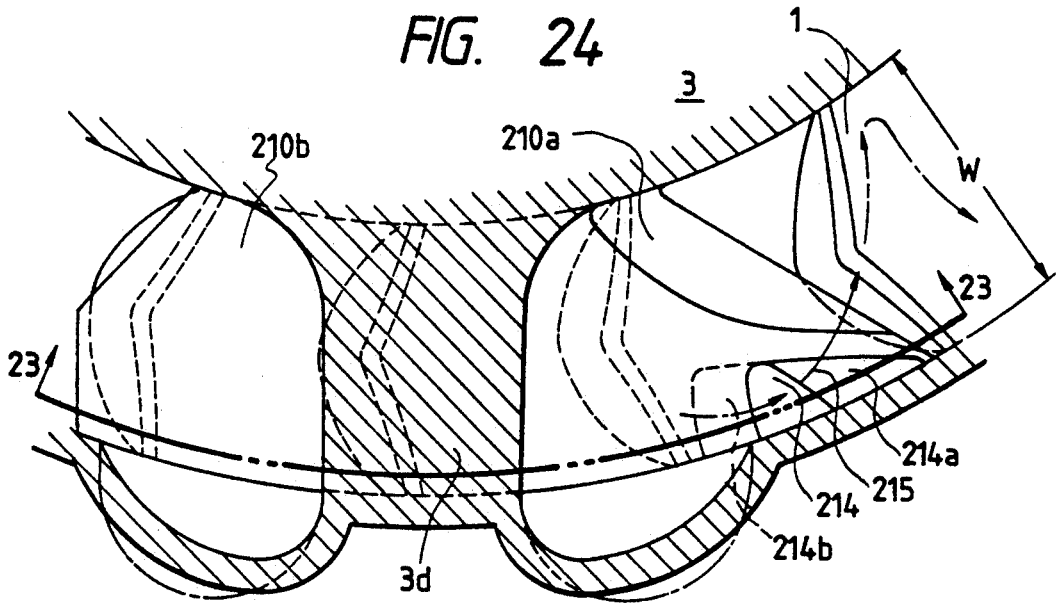
FIG. 24 is a sectional view taken along line 24—24 of FIG. 23.
Figure 25:
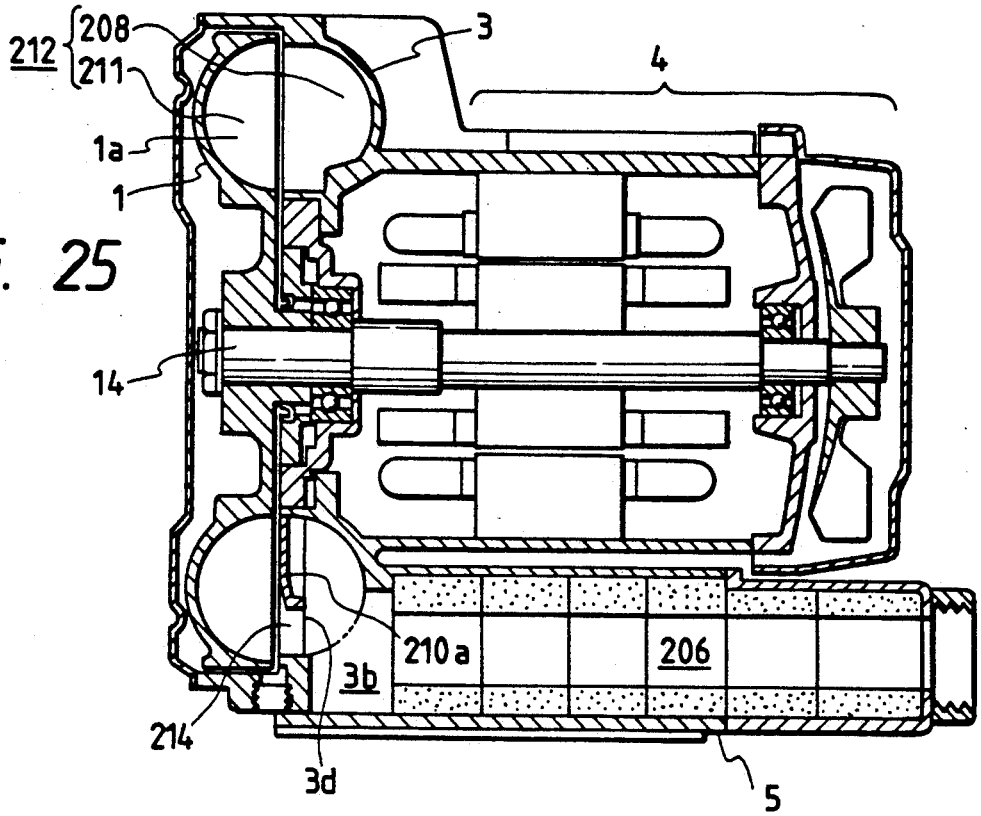
FIG. 25 is a sectional side view showing the entire construction of the centrifugal blower of the embodiment of FIG. 23.
Figure 26:
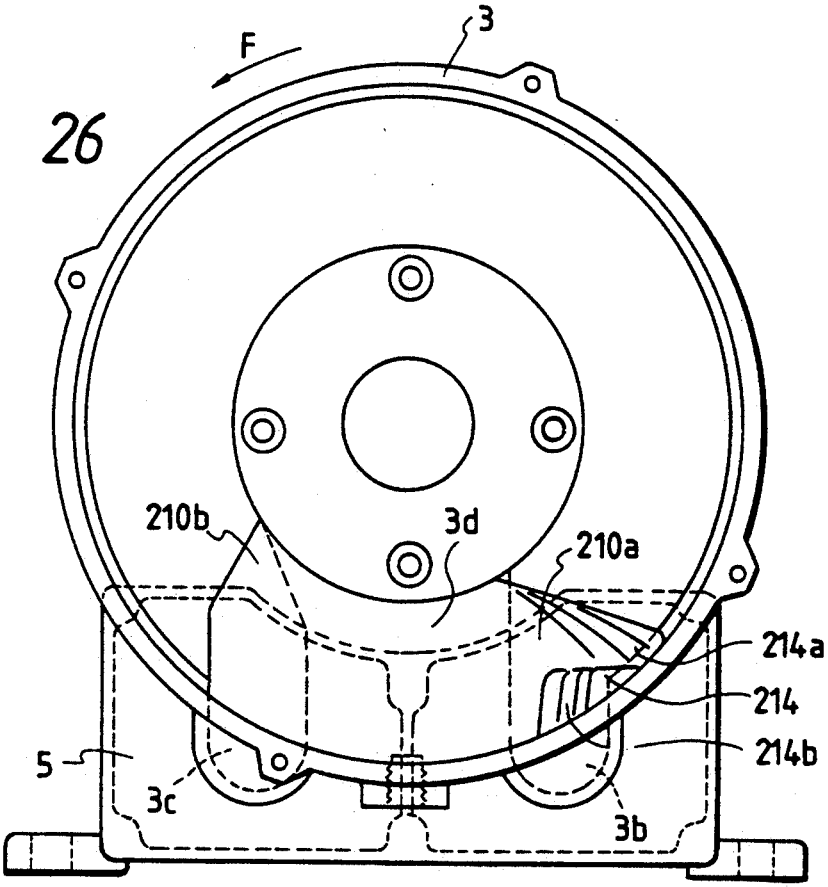
FIG. 26 is a front view of the centrifugal blower of FIG. 23 with a side cover and the impeller removed.

A further embodiment of the present invention will now be described with reference to FIGS. 23 and 24 wherein FIG. 23 is a sectional view of a principal portion of the centrifugal pump showing the suction and discharge ports and the vicinity thereof and FIG. 24 is a sectional view taken along line 24—24. In these figures, the casing 3 has the annular groove 3*a* providing an annular flow path 208. The annular flow path 208 is in the form of the annular groove which is a generally semi-arcuate slot in its section which opens in a direction parallel to the axis of the rotating shaft 14 of the prime mover One end of the flow path 208 of the annular groove is in communication with a suction port 3*b*, while an opposite end thereof is in communication with a discharge port 3*c*. The section from the discharge port 3*c* to the suction port 3*b* is partitioned by a partition wall 3*b* which is opposed to the impeller through a very small gap. A suction-side passage 206 contiguous to the suction port 3*b* and a discharge-side passage contiguous to the discharge port 3*c* are provided in parallel within a silencer or muffler casing 5 which also serves as a base member as shown in FIG. 25.

The impeller 1 is composed of a shroud and a plurality of blades or vanes and the shroud has an annular slot 211 which opens axially in an opposed relation to the annular flow path 208, centered on the rotating shaft 14. The opening portion of the annular flow path 208 and that of the shroud are opposed to each other by fixing the impeller 1 onto the rotating shaft 14 of the prime mover or motor, whereby an annular flow path 212 having a circular section is formed.

Figure 27:
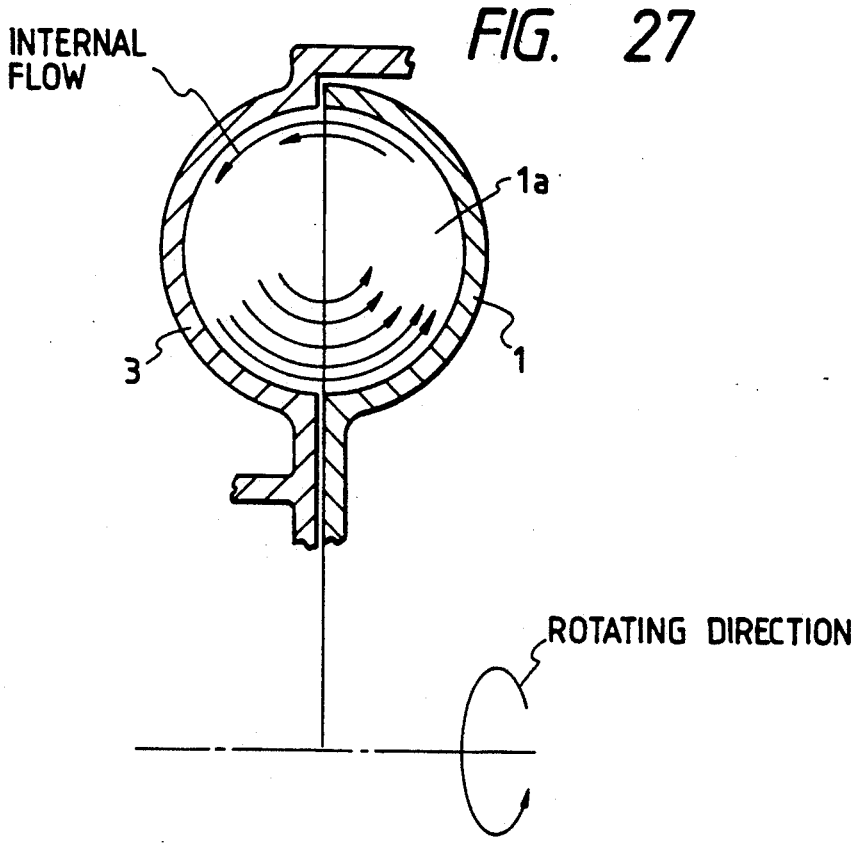
FIG. 27 is a view for explaining the operating principle of the centrifugal blower.
Figure 28:
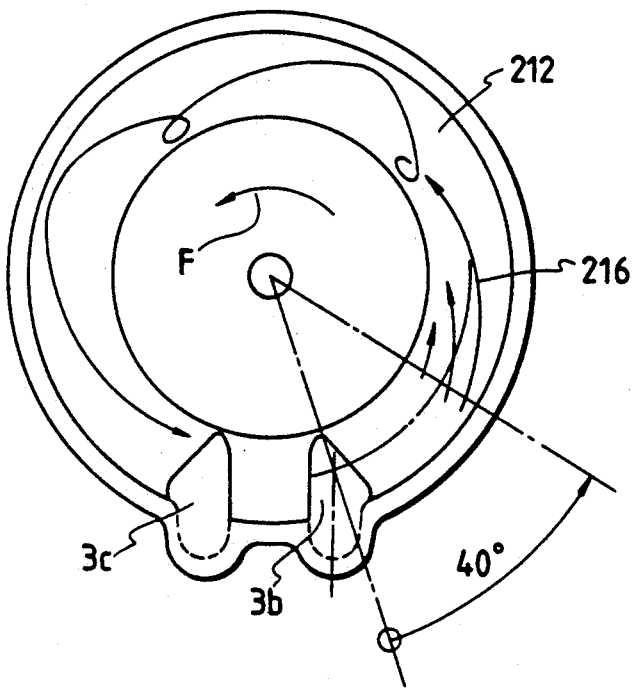
FIG. 28 is a view for explaining the vortex flow principle of the centrifugal blower.

Upon rotation of the motor, the impeller 1 fixed onto the rotating shaft 14 rotates. As a result, a fluid such as a gas which has been introduced from the suction port 3*b* rotates while describing a spiral or vortex flow as indicated by arrows in the annular flow path 212 of a circular section composed of the annular flow path 208 and the shroud under the action of the vanes 1*a* of the impeller, as shown in FIGS. 27 and 28. The gas is pressurized by the vanes 1*a* and is conveyed gradually in the rotating direction indicated at F. The thus-pressurized gas is conducted to the discharge port 6*c* by the action of the partition wall 3*d* and is discharged therefrom.

As illustrated in FIG. 23, which is a sectional view of a principal portion showing a relation among the partition wall 3*d*, the suction and discharge ports 3*b*, 3*c* and the impeller 1, the partition wall 3*d* is provided at a front end portion thereof opposed to the impeller 1 with a flow guide 210 such as plate member having a suction-side flow guide portion 210*a* for conducting the gas introduced from the suction port 3*b* smoothly to the annular flow path 212 and a discharge side flow guide portion 210*b* for conducting the gas which has been pressurized to the discharge port 3*c* smoothly. As is apparent also from this figure, the gas which has been pressurized by the impeller 1 is conducted to the discharge port 3*c* by the action of the partition wall 3*d* as indicated with arrow OUT. However, the outlet for gas 213 which was allowed to remain between adjacent vanes 1*a* at the time of discharge is closed with the partition wall 3*d*, so the gas 213 is carried as it is to the suction port 3*b* side and is thus carried over to the suction side. This is called a carry-over flow. After decrease in the number of revolutions, the carry-over flow passes the partition wall 3*d* and is conveyed to the suction side. On the suction side, this pressurized fluid is released throughout the entire width of the vane 1*a* and expands without rotation substantially uniformly within the annular flow path 212. This expanded flow is mixed with gas introduced from the suction port 3*b* and indicated by arrow IN, thus disturbing the flow of the influent gas. Due to this disturbance, the gas which has been introduced through the suction port 3*b* from the exterior cannot start forming a rotating flow smoothly in the flow path portion near the suction port 3*b*, and only after passing this mixing region, it forms an effective rotating flow. According to an experimental measurement made by the present inventors, the mixing region reached 40° in terms of the angle of circumference from the suction port 3*b* to the discharge port 3*c* side, as shown in FIG. 28.

In this embodiment, in view of the point just mentioned above, a communication path 214 which is in communication with the suction port 3*b* from the surface side opposed to the vanes 1*a* is provided on the outer periphery side of the suction-side flow guide portion 210*a* of flow guide 210 on the partition wall 3*d*, as shown in FIG. 23. This communication path constitutes an auxiliary flow supply path. The gas 213 remaining between adjacent vanes 1*a* passes through the communication path 214 before expanding in the vicinity of a front end of the suction-side flow guide portion 210*a* and is jetted to the suction port 3*b* side as indicated by arrow 215. The communication path 214 is provided at an angle which is obliquely forward relative to an advancing direction of the vanes 1*a* so that the gas jetted from the path 214 can rotate smoothly in the annular flow path 212. Of particular importance in this connection is a surface 214*a* of the communication path 214 which surface in positioned forward relative to the advancing direction of the vanes 1*a*. The angle of the surface 214*a* in designated $\alpha$. In this embodiment, the angle of a surface 214*b* positioned behind the surface 214*a* is also set at the same value. As to a radial position of the communication path 214 with respect to the impeller 1, the path 214 is disposed on a more outer periphery side of the vane 1*a*, as shown in FIG. 24. This is because the gas is compressed more outwards centrifugally by the vanes 1*a* and also because such position is advantageous to the formation of a rotating flow.

According to this embodiment, since the communication path 214 is formed in the outer periphery portion of the suction-side flow guide portion 210*a* of the flow guide 210 on the partition wall 3*d*, the carry-over flow present on the outer periphery side of the impeller 1, of the gas 213 compressed and remaining between adjacent vanes 1*a* due to the presence of the partition wall 3*d*, flows out from the communication path 214 and forms a jet 215. The jet 215 flows to the inner periphery side of the casing 3 along the inner wall of the casing, then further flows to the inner periphery side of the impeller 1 and forms a rotating flow. At this time, the gas present around the jet 215 is dragged by the jet and is conducted in the rotating direction. On the other hand, the compressed gas 213 which is allowed to remain between adjacent vanes 1*a* due to the presence of the partition wall 3*d* flows out from the outer periphery side under the action of the communication path 214, so that the inner periphery side between adjacent vanes 1*a* assumes a gas-free state and hence, in the vicinity of the suction port 3*b* immediately adjacent to the suction-side flow guide portion 210*a*, the gas which has been introduced from the exterior flows into the impeller easily. Thus, because of the generation of a rotating flow by the jet 215 and the easiness of the suction of gas to the inner periphery side of the impeller 1, a rotating flow 216 is formed smoothly in the vicinity of the suction port 3b just after passing the suction-side flow guide portion 210a. At the same time, the wetted perimeter length also increases. Near the suction port 3b, therefore, the mixing region from the suction port 3b to the discharge port 3c becomes smaller and the wetted perimeter length increases, in comparison with the prior art, so that in this centrifugal blower the pressure rising action is enhanced in proportion to the angle of circumference and the wetted perimeter length. As a result, it becomes possible for the centrifugal blower to increase its discharge pressure and improve its performance. Further, since a rotating flow is formed smoothly in the vicinity of the suction port 3b just after passing the suction-side flow guide portion 210a because of the generation of the rotating flow 216 by the jet 215 and because of the easiness of the suction of gas to the inner periphery side of the impeller 1, the disturbance of gas in this region decreases, so that the generation of noise can be much suppressed and there can be obtained a noise damping effect.

According to an experimental measurement made by the present inventors, it was determined that an angle $\alpha$ of the communication path 214 relative to the advancing direction of the vanes 1a in the range of 5° to 35° was desirable in forming the rotating flow. In this embodiment, the angle $\alpha$ is set at 20°, and a radial size of the communication path 214 is set at a width of ⅓ of the vane width W. But this arrangement is for obtaining a greater effect. The radial size of the communication path 214 may cover the entire vane width, preferably on the outer periphery side. If a still greater effect is to be attained, it is desirable that the radial position of the communication path be on the outer side, more preferably 1/6 or more on the outer side, from the center of the vane width W. Further, as to a circumferential position of the communication path 214, a good result was obtained when a rear-end position B relative to the advancing direction of the vanes 1a was at a distance from a front-end position A of the discharge-side flow guide portion 210b in the range from 1.5 to 2.5 times the spacing between adjacent vanes 1a. However, the opening position of the communication path 214 on the side opposed to the impeller 1 is not limited to such position if only the compressed gas remaining between adjacent vanes 1a can be introduced into the communication path. Not only the opening may be on the suction-side flow guide portion 210a as in the embodiment, but also it may span both the suction- and discharge-side flow guide portions 210a, 210b.

Figure 29:
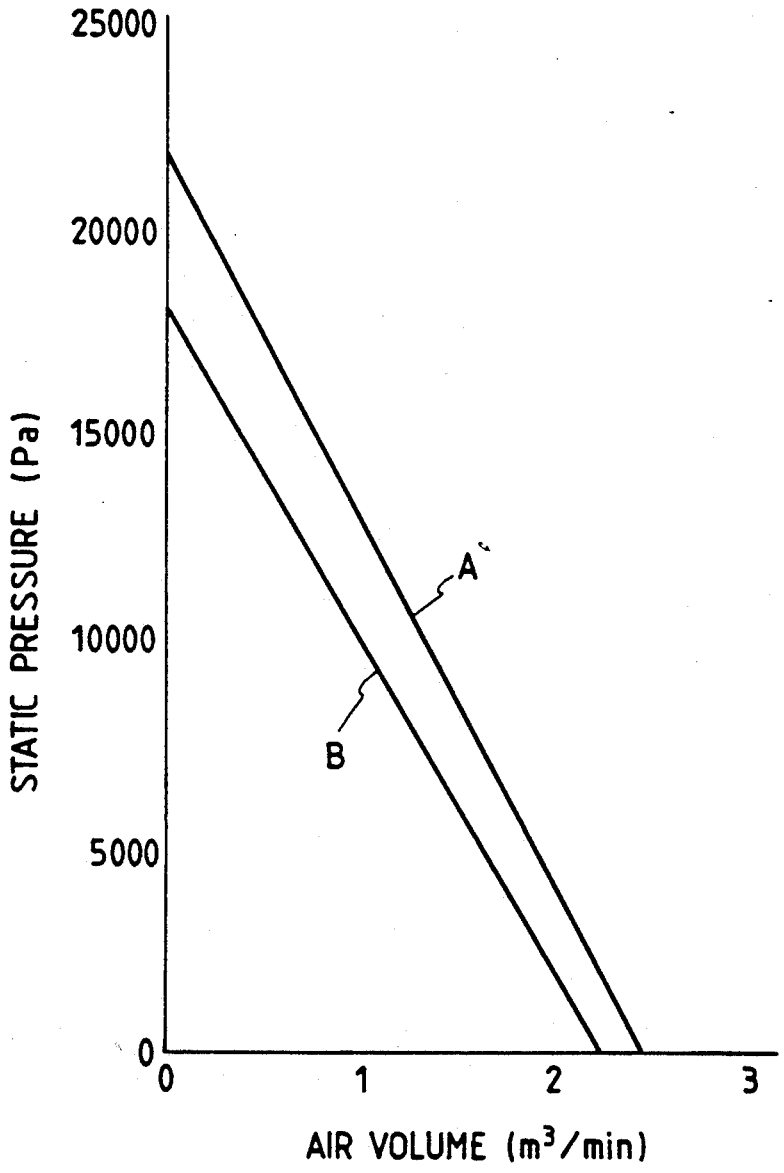
FIG. 29 is an aerodynamic characteristic diagram showing experimental results obtained with the embodiment of FIG. 23.

FIG. 29 is a characteristic diagram showing air volume-static pressure characteristic of the centrifugal blower of this embodiment and that of a conventional centrifugal blower. In the same figure, a curve A represents an aerodynamic characteristic obtained in the presence of the communication path according to this embodiment, while a curve B represents an aerodynamic characteristic obtained in the absence of such communication path according to the prior art. These characteristics were obtained under the following conditions: motor used . . . 0.75 kW, effective dia. of the impeller . . . 235 mm, number of revolutions of the motor . . . 3,420 r.p.m., gap between the impeller and the partition wall . . . 0.3 mm, angle of the communication path . . . 20°. As is apparent also from this figure, the aerodynamic characteristic in this embodiment could be improved about 20% as a whole in comparison with that in the prior art.

Figure 30:
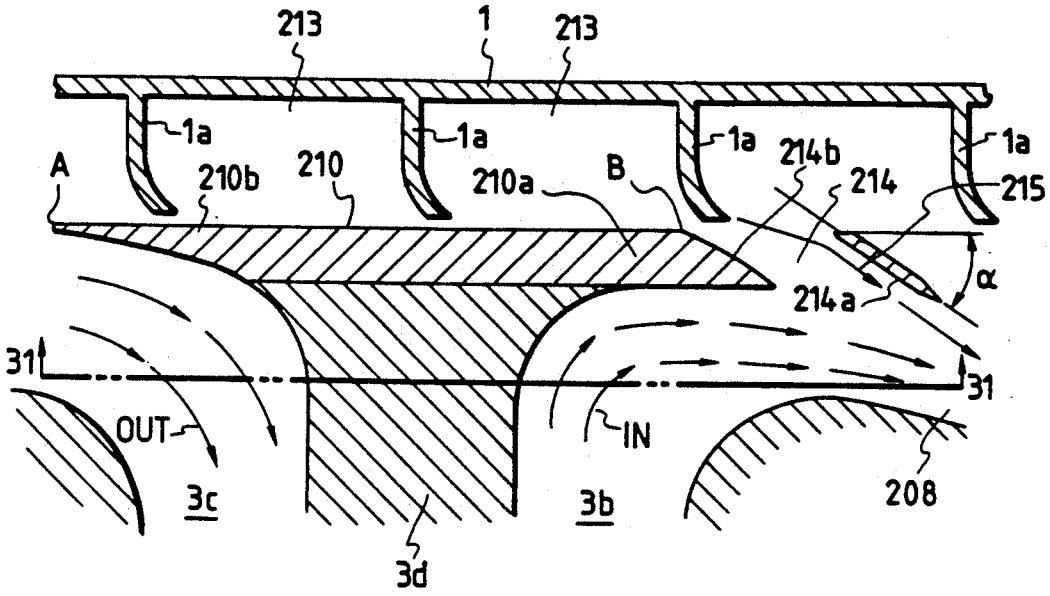
FIG. 30 is a sectional view of a principle portion of a centrifugal blower, showing another embodiment of the present invention.
Figure 31:
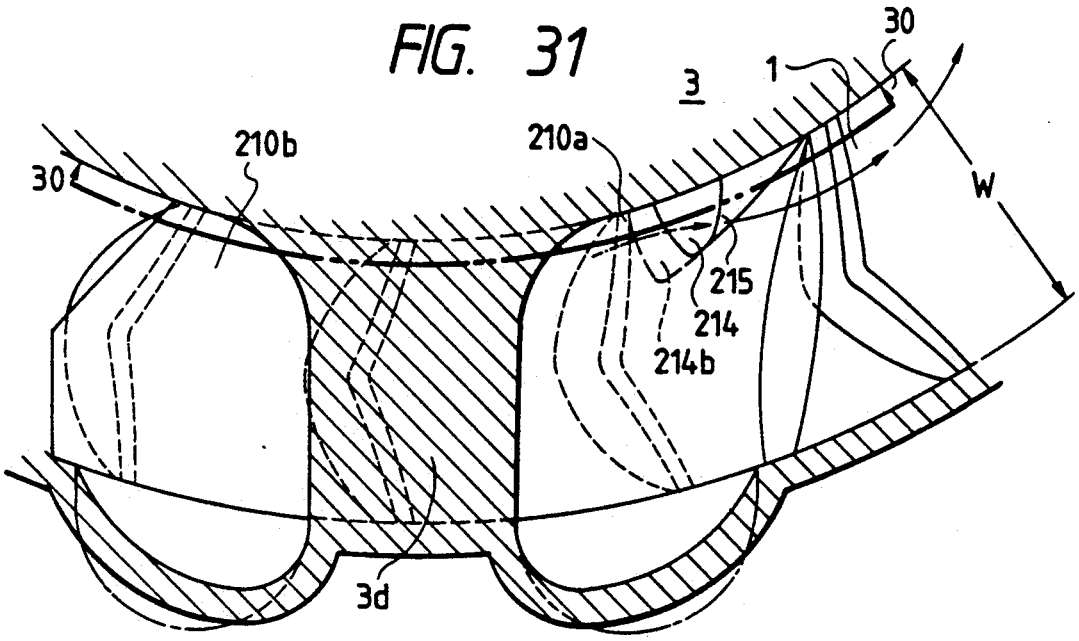
FIG. 31 is a sectional view taken along line 31—31 of FIG. 30.
Figure 32:
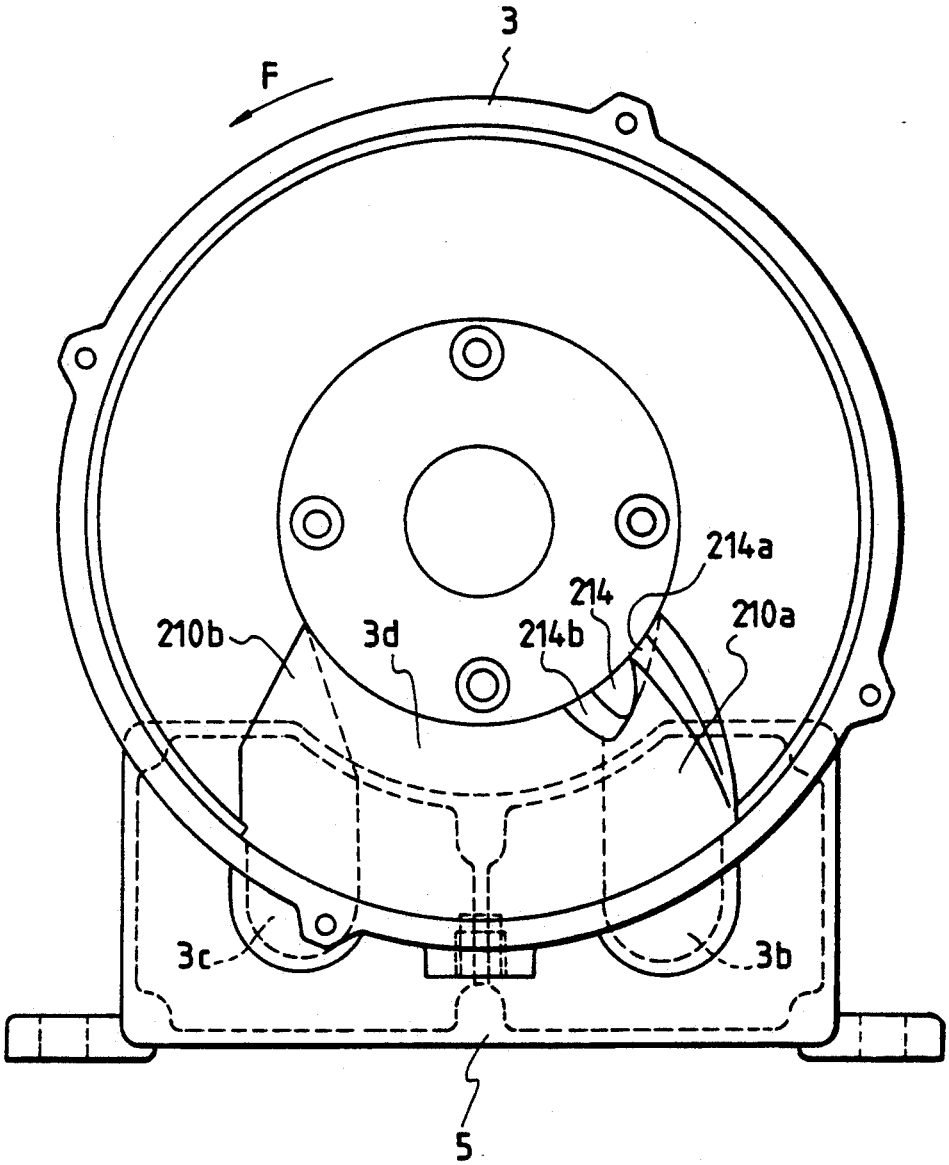
FIG. 32 is a front view of the centrifugal blower of FIG. 30 with a side cover and a impeller removed.

According to another embodiment of the present invention, the invention is applied to an inner periphery side of a cup type centrifugal blower, such as a centrifugal gas pump. FIG. 30 is a sectional view of a principal portion thereof comprising suction and discharge ports and the vicinity thereof, and FIG. 31 is a sectional view taken along line 31—31 of FIG. 30. FIG. 32 is a front view showing a state with a side cover and the impeller removed.

The constructions of components, the principle of operation and problems involved in the conventional structure are the same as those referred to in the previous embodiment.

According to this embodiment, as shown in FIG. 31, a communication path 214 which is in communication with the suction port 3b side from its surface side opposed to a vane 1a, is provided on the inner periphery side of the suction-side flow guide portion 210a of the flow guide 210 provided on the partition wall 3d. This constitutes an auxiliary flow supply path. The gas 213 remaining between adjacent vanes 1a passes through the communication path 214 before expanding in the vicinity of the front end of the suction-side flow guide portion 210a and is jetted to the suction port 3b side as indicated by arrow 215. The communication path 214 is provided at an angle of a obliquely forwards relative to the advancing direction of the vanes 1a so that the gas jetted from the path 214 can rotate smoothly in the annular flow path 212. Of particular importance in this connection is a surface 214a of the communication path 214 which surface is positioned forwards relative to the advancing direction of the vanes 1a. The angle of the surface 214a is designated $\alpha$. As to a radial position of the communication path 214 with more inner periphery side of the vanes 1a, as shown in FIG. 31. This is for avoiding a delayed start of rotation on the inner periphery side while the gas is compressed more outwards centrifugally by the vanes 1a and rotation is started from the outer periphery side.

According to this embodiment, since the communication path 214 is formed in the inner periphery portion of the suction-side flow guide portion 210a of the flow guide 210 on the partition wall 3d, the carry-over flow present on the inner periphery side of the impeller 1, of the gas 213 compressed and remaining between adjacent vanes 1a due to the presence of the partition wall 3d, flows out from the communication path 214 and forms a jet 215. The jet 215 flows to the inner periphery side of the casing along the inner wall of the casing, then further flows to the inner periphery side of the impeller 1 and forms a rotating flow. At this time, the gas present around the jet 215 is dragged by the jet and is conducted in the rotating direction. On the other hand, the compressed gas 213 which is allowed to remain between adjacent vanes 1a due to the presence of the partition wall 3d flows out from the communication path 214 and the pressure thereof is reduced. Consequently, on the inner periphery side between adjacent vanes 1a, and in the vicinity of the suction port 3b immediately after passing the suction side flow guide portion 210a of the flow guide 210 on the partition wall 3d, the gas introduced from the exterior easily flows into the impeller 1. Thus, because of the generation of a rotating flow by the jet 215 and the easiness of the suction of gas to the inner periphery side of the impeller 1, a rotating flow 216 is formed smoothly in the vicinity of the suction port 3*a* just after passing the suction-side flow guide portion 210*a*, and at the same time the wetted perimeter length also increases. Near the suction port 3*b*, therefore, the mixing region from the suction port to the discharge port 3*c* becomes smaller and the wetted perimeter length increase, in comparison with the prior art, so that in this centrifugal blower the pressure rising action is enhanced in proportion to the angle of circumference and the wetted perimeter length. As a result, it becomes possible for the centrifugal blower to increase its discharge pressure and improve its performance. Further, since a rotating flow is formed smoothly in the vicinity of the suction port 3*b* just after passing the suction-side flow guide portion 210*a* because of the generation of the rotating flow 216 by the jet 215 and because of the easiness of the suction of gas to the inner periphery side of the impeller 1, the disturbance of gas in this region decreases, so that the generation of noise can be so much suppressed and there can be obtained a noise damping effect.

According to an experimental measurement conducted by the present inventors, was determined out that an angle $\alpha$ of the communication path 214 relative to the advancing direction of the vanes 1*a* in the range of 5° to 35° was desirable in forming the rotating flow. In this embodiment, the angle $\alpha$ is set at 20°, and a radial size of the communication path 214 is set at a width of $\frac{1}{3}$ of the vane width W. But this arrangement is for obtaining a greater effect. The radial size of the communication path 214 may cover the entire vane width, preferably on the inner periphery side. If a still greater effect is to be attained, it is desirable that the radial position of the communication path be about $\frac{1}{3}$ or more on the inner side from the center of the vane width W. Further, as to a circumferential position of the communication path 214, a good result was obtained when a rear-end position B relative to the advancing direction of the vanes 1*a* was at a distance from a front-end position A of the discharge-side flow guide portion 210*b* in the range from 1.5 to 2.5 times the spacing between adjacent vanes 1*a*. However, the opening position of the communication path 214 on the side opposed to the impeller 1 is not limited to such position if only the compressed gas remaining between adjacent vanes 1*a* can be introduced into the communication path. Not only the opening may be on the suction-side flow guide portion 210*a* as in this embodiment, but also it may span both the suction-side and discharge-side flow guide portions 210*a*, 210*b*.

Figure 33:
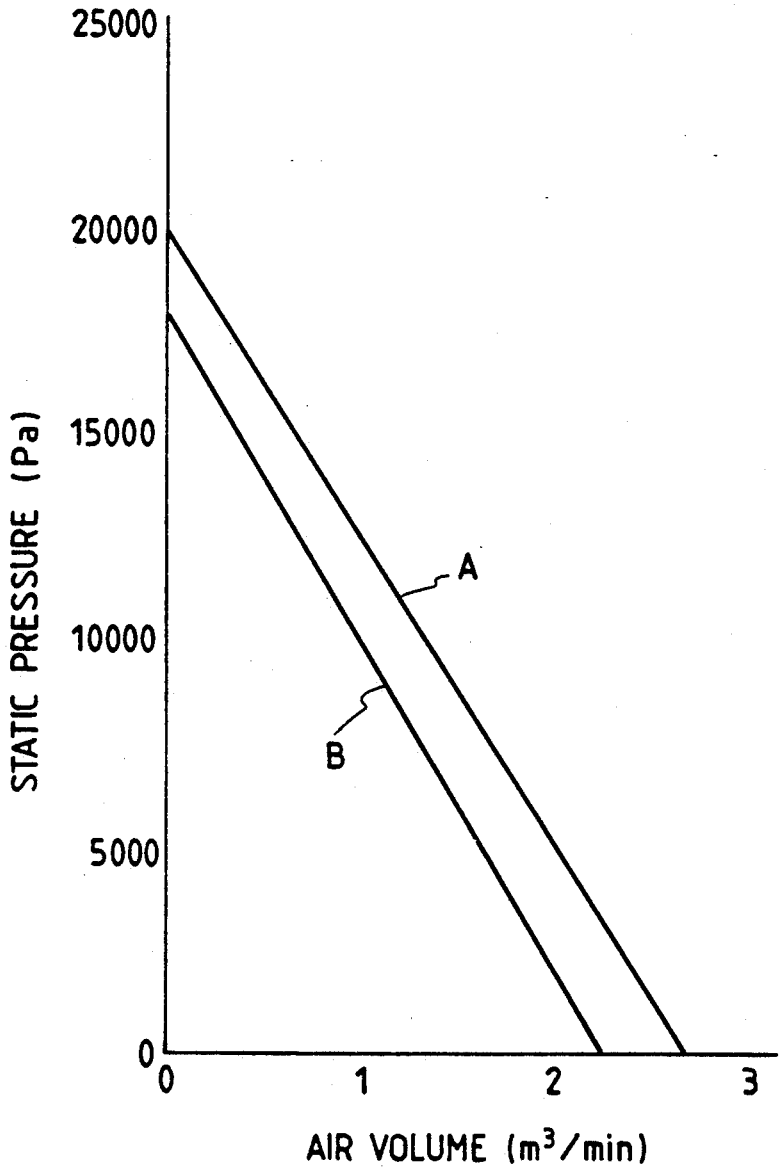
FIG. 33 is an aerodynamic characteristic diagram showing experimental results obtained with the embodiment of FIG. 30.

FIG. 33 is a characteristic diagram showing air volume - static pressure characteristic of the centrifugal blower of this embodiment and that of a conventional centrifugal blower. In the same figure, a curve A represents an aerodynamic characteristic obtained in the presence of the communication path according to this embodiment, while a curve B represents an aerodynamic characteristic obtained in the absence of such communication path according to the prior art. These characteristics were obtained under the following conditions: motor used . . . 0.75 kW, effective dia. of the impeller . . . 235 mm, number of revolutions of the motor . . . 3,420 r.p.m., gap between the impeller and the partition wall . . . 0.3 mm, angle of the communication path . . . 20°. As is apparent also from this figure, the aerodynamic characteristic in this embodiment could be improved about 20% as a whole in comparison with that in the prior art.

Figure 34:
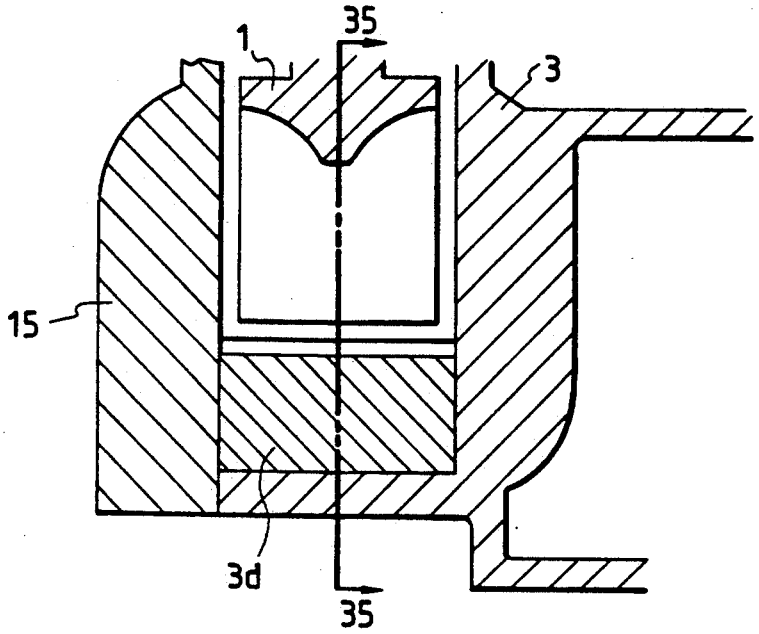
FIG. 34 is a sectional view of a principal portion of a centrifugal blower, showing a further embodiment of the present invention.
Figure 35:
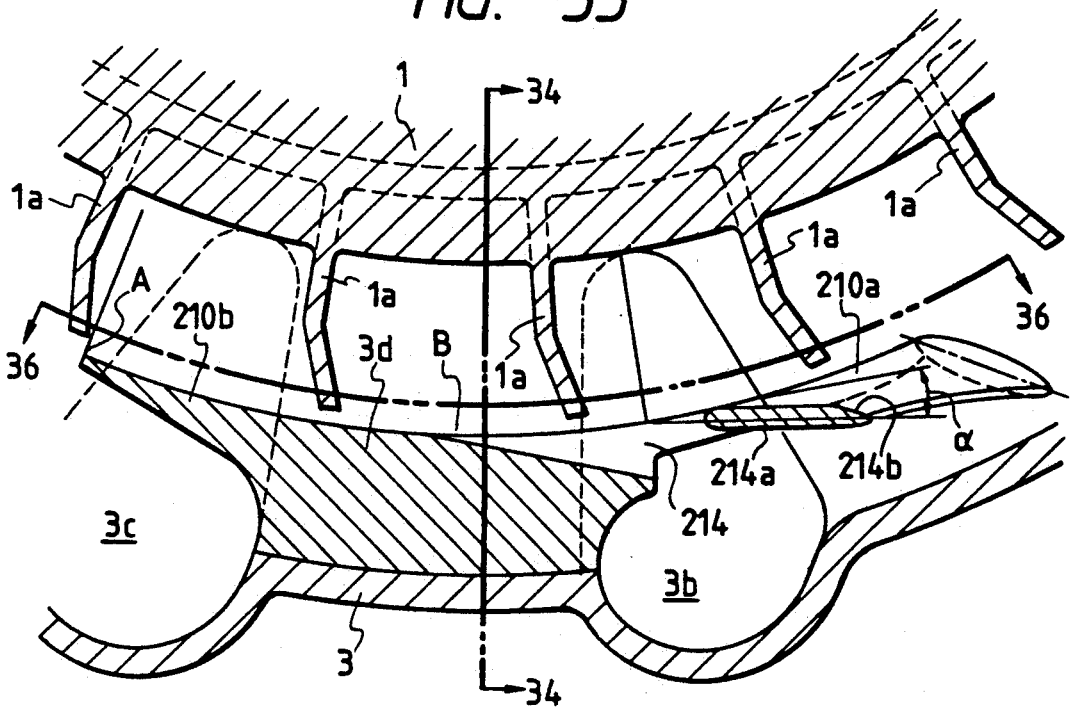
FIG. 35 is a sectional view taken along line 35—35 of FIG. 34.

According to a further embodiment of the present invention, the invention is applied to an outer periphery side of a double-side vane type centrifugal blower, such as a centrifugal gas pump. FIG. 34 is a sectional view of a principal portion thereof comprising a suction port and the vicinity thereof, FIG. 35 is a sectional view taken along line 35—35 of FIG. 34, FIG. 36 is a sectional view taken along line 36—36 of FIG. 35, and FIG. 37 is a sectional side view showing the entire construction of this embodiment.

In these figures, the numeral 1 denotes an impeller, numeral 3 denotes a casing which forms an annular flow path 208, and numeral 15 denotes a side cover which forms the annular flow path 208. The annular flow path 208 is in the form of a generally semi-arcuate slot in its section which opens in a direction parallel to the axis of a rotating shaft 14 of the prime mover. The flow path 208 is constituted in an annular shape, centered on the rotating shaft 14. One end of the flow path 208 is in communication with a suction port 3*b*, while an opposite end thereof is in communication with a discharge port 3*c*. The section from the discharge port 3*c* to the suction port 3*b* is partitioned by a partition wall 3*d* which is opposed to the impeller 1 through a very small gap. A suction-side passage 206 contiguous to the suction port 3*b* and a discharge-side passage contiguous to the discharge port 3*c* are provided in parallel within a silencer or muffler casing 5 which also serves as a base member.

Figure 36:
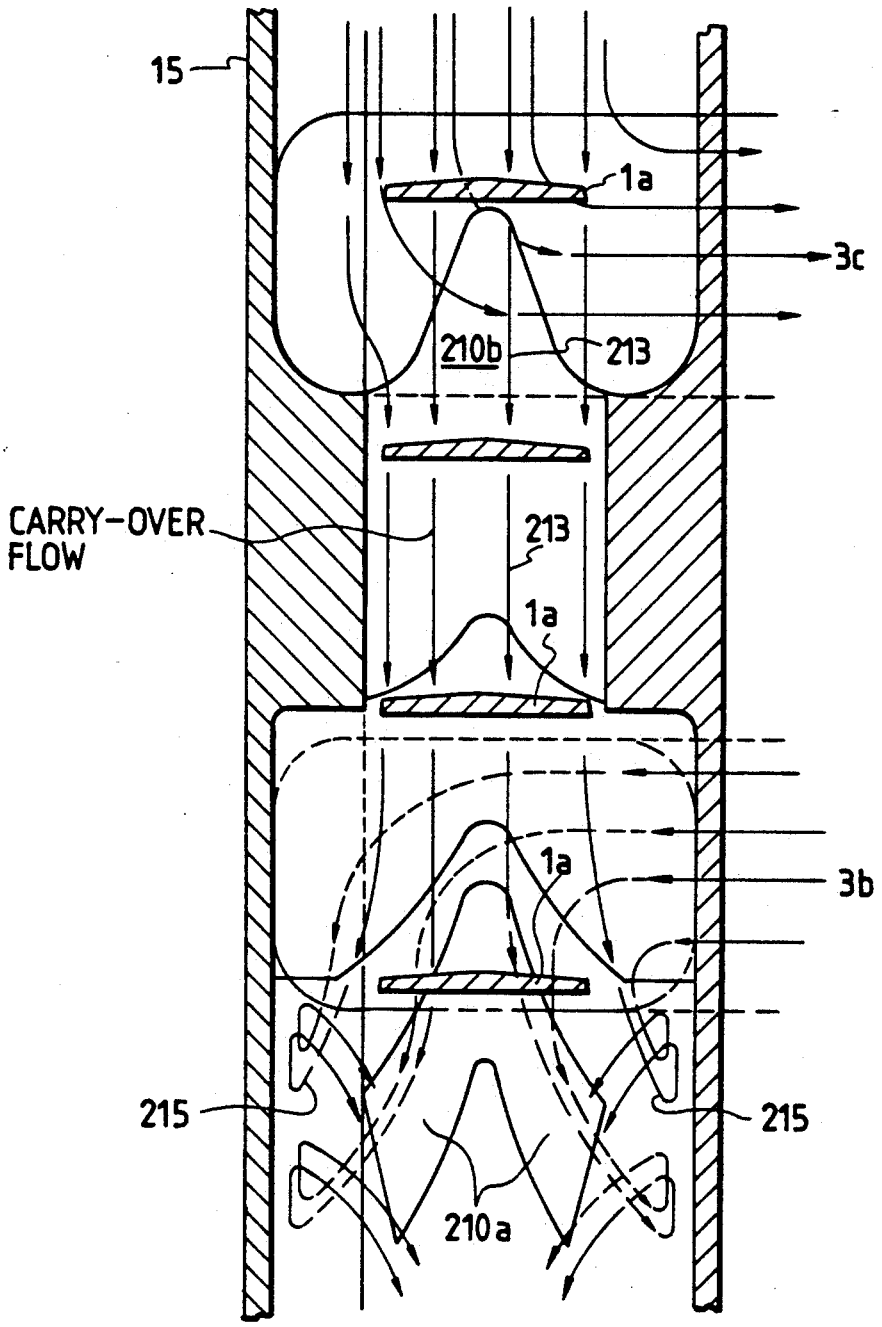
FIG. 36 is a sectional view taken along line 36—36 of FIG. 35.
Figure 37:
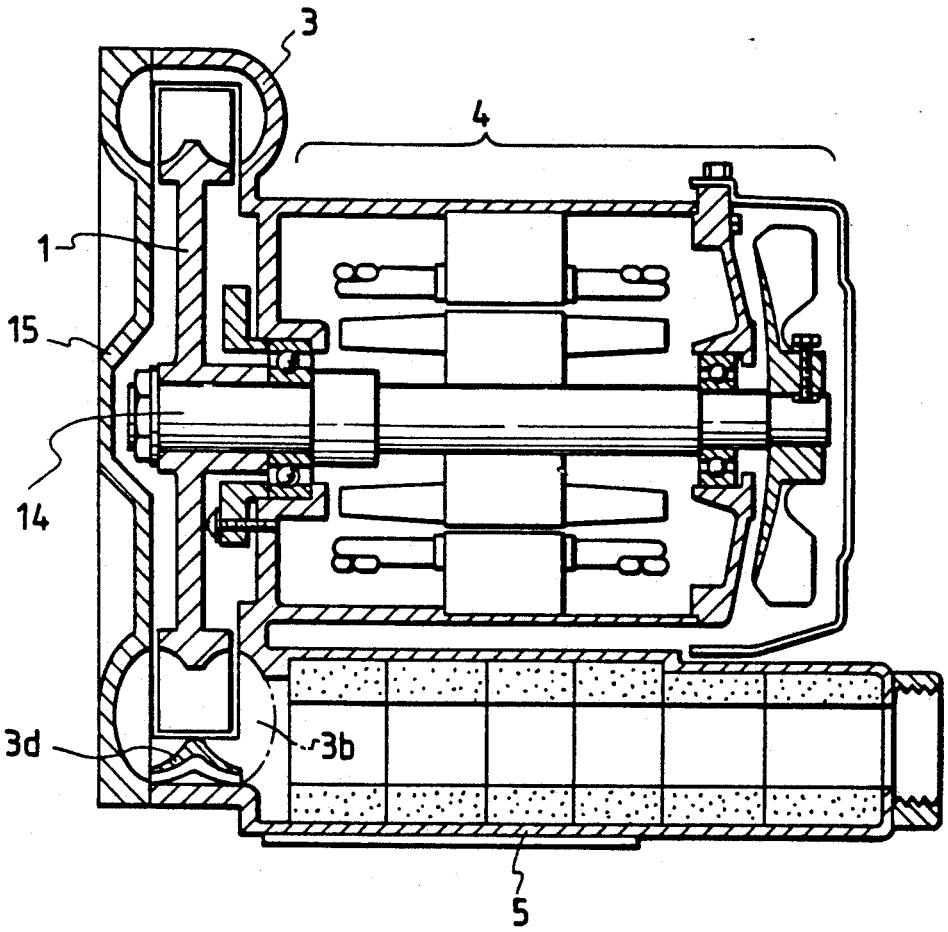
FIG. 37 is a sectional view showing the entire construction of the centrifugal blower of FIG. 34.

The impeller 1 is composed a hub and a large number of blades or vanes 1*a* as shown in FIG. 36. The hub has an annular slot 211 which opens axially on both sides in an opposed relation to the annular flow path 208, centered on the rotating shaft 14. The vanes 1*a* are provided in a large number in a traversing direction for the slot 211. The opening portion of the annular flow path 208 and that of the hub are opposed to each other by fixing the impeller 1 onto the rotating shaft 14 of the primer mover, whereby an annular flow path 212 having a generally circular section is formed.

Upon rotation of the prime mover, the impeller 1 fixed onto the rotating shaft 14 rotates. As a result, the gas which has been introduced from the suction port 3*b* rotates while describing a spiral flow as indicated by arrows in the annular flow path 212 of a circular section composed of the annular flow path 208 and the hub under the action of the vanes 1*a* of the impeller 1, as shown in FIGS. 35 and 36. The gas is pressurized by the vanes 1*a* and is conveyed gradually in the rotating direction. The thus-pressurized gas is conducted to the discharge port 3*c* by the action of the partition wall 3*d* and is discharged therefrom.

As illustrated in FIG. 36, which is a sectional view of a principal portion showing a relation among the partition wall 3*d*, the suction and discharge ports 3*b*, 3*c*, and the impeller 1, the partition wall 3*d* is provided at a front end portion thereof opposed to the impeller 1 with a flow guide 210 having a suction-side flow guide portion 210*a* for conducting the gas introduced from the suction port 3*b* smoothly to the annular flow path 212 and a discharge-side flow guide portion 210*b* for conducting the gas which has been pressurized to the discharge port 3*c*. As is apparent also from this figure, the gas which has been pressurized by the impeller 1 is conducted to the discharge port 3*c* by the action of the partition wall 3*d* as indicated with arrow OUT. However, the outlet for gas 213 which was allowed to remain between adjacent vanes at the time of discharge is closed with the partition wall 3d, so the gas 213 is carried as it is to the suction port 3b side and is thus carried over to the suction side. This is called a carry-over flow. After decrease in the number of revolutions, the carry-over flow passes the partition wall 3d and is conveyed to the suction side. On the suction side, this pressurized fluid is released throughout the entire circumference of the vane 1a and expands without rotation substantially uniformly within the annular flow path 212. This expanded flow is mixed with gas introduced from the suction port 3b and indicated by arrow IN, thus disturbing the flow of the influent gas. Due to this disturbance, the gas which has been introduced through the suction port 3b from the exterior cannot start forming a rotating flow smoothly in the flow path portion near the suction port 3b, and only after passing this mixing region, it forms an effective rotating flow.

In this embodiment, in view of the point just mentioned above, a communication path 214 which in communication with the suction port 3b from the surface side opposed to the vanes 1a, is provided on the outer periphery side of the suction-side flow guide portion 210a of the flow guide 210 on the partition wall 3d. This communication path constitutes an auxiliary flow supply path. The gas 213 remaining between adjacent vanes 1a passes through the communication path 214 before expanding in the vicinity of a front end of the suction-side flow guide portion 210a and is jetted to the suction port 3b side as indicated by arrow 215. The communication path 214 is provided at an angle of $\alpha$ obliquely forwards relative to an advancing direction of the vanes 1a so that the gas jetted from the path 214 can rotate smoothly in the annular flow path 212. Of particular importance in this connection is a surface 214a of the communication path 214 which surface is positioned forward relative to the advancing direction of the vanes 1a. The angle of the surface 214a is designated $\alpha$. In this embodiment, the angle of a surface 214b positioned behind the surface 214a is also set at the same value. As to a radial position of the communication path 214 with respect to the impeller 1, the path 214 is disposed on a more outer periphery side of the vane 19, as shown in FIG. 24. This is because the gas is compressed more outwards centrifugally by the vanes 1a and also because such position is advantageous to the formation of a rotating flow.

According to this embodiment, since the communication path 214 is formed in the outer periphery portion of the suction-side flow guide portion 210a of the flow guide 210 on the partition wall 3d, the carry-over flow present on the outer periphery side of the impeller 1, of the gas 213 compressed and remaining between adjacent vanes 1a due to the presence of the partition wall 3d, flows out from the communication path 214 and forms a jet 215. The jet 215 flows to the inn®r periphery side of the casing 3 along the inner wall of the casing, then further flows to the inner periphery side of the impeller 1 and forms a rotating flow. At this time, the gas present around the jet 215 is dragged by the jet and is conducted in the rotating direction. On the other hand, the compressed gas 213 which is allowed to remain between adjacent vanes 1a due to the presence of the partition wall 3d flows out from the outer periphery side under the action of the communication path 214, so that the inner periphery side between adjacent vanes 1a assumes a gas-free state and hence, in the vicinity of the suction port 3b immediately adjacent to the suction-side flow guide portion 210a, the gas which has been introduced from the exterior flows into the impeller easily. Thus, because of the generation of a rotating flow by the jet 215 and the easiness of the suction of gas to the inner periphery side of the impeller 1, a rotating flow 216 is formed smoothly in the vicinity of the suction port 3b just after passing the suction-side flow guide portion 210a. At the same time, the wetted perimeter length also increases. Near the suction port 3b, therefore, the mixing region from the suction port to the discharge port 3c becomes smaller and the wetted perimeter length increases, in comparison with the prior art, so that in this centrifugal blower the pressure rising action is enhanced in proportion to the angle of circumference and the wetted perimeter length. As a result, it becomes possible for the centrifugal blower to increase its discharge pressure and improve its performance. Further, since a rotating flow is formed smoothly in the vicinity of the suction port 3b just after passing the suction-side flow guide portion 210a because of the generation of the rotating flow 216 by the jet 215 and because of the easiness of the suction of gas to the inner periphery side of the impeller 1, the disturbance of gas in this region decreases, so that the generation of noise can be so much suppressed and there can be obtained a noise damping effect.

According to an experimental measurement made by the present inventors, it was determined that an angle of the communication path 214 relative to the advancing direction of the vanes 1a in the range of 5° to 35° was desirable in forming the rotating flow. In this embodiment, the angle $\alpha$ is set at 12°, and a radial size of the communication path 214 is set at a width of ⅓ of the vane width W. But this arrangement is for obtaining a greater effect. The radial size of the communication path 214 may cover the entire vane width, preferably on the outer periphery side. If a still greater effect is to be attained, it is desirable that the radial position of the communication path be on the outer side, more preferably 1/6 or more on the outer side, from the center of the vane width W. Further, as to a circumferential position of the communication path 214, a good result was obtained when a rear-end position B relative to the advancing direction of the vanes 1a was at a distance from a front-end position A of the discharge-side flow guide portion 210b in the range from 1.5 to 2.5 times the spacing between adjacent vanes 1a. However, the opening position of the communication path 214 on the side opposed to the impeller 1 is not limited to such position if only the compressed gas remaining between adjacent vanes 1a can be introduced into the communication path. Not only the opening may be on the suction-side flow guide portion 210a as in the embodiment, but also it may span both the suction-side and discharge-side flow guide portions 210a, 210b.

Figure 38:
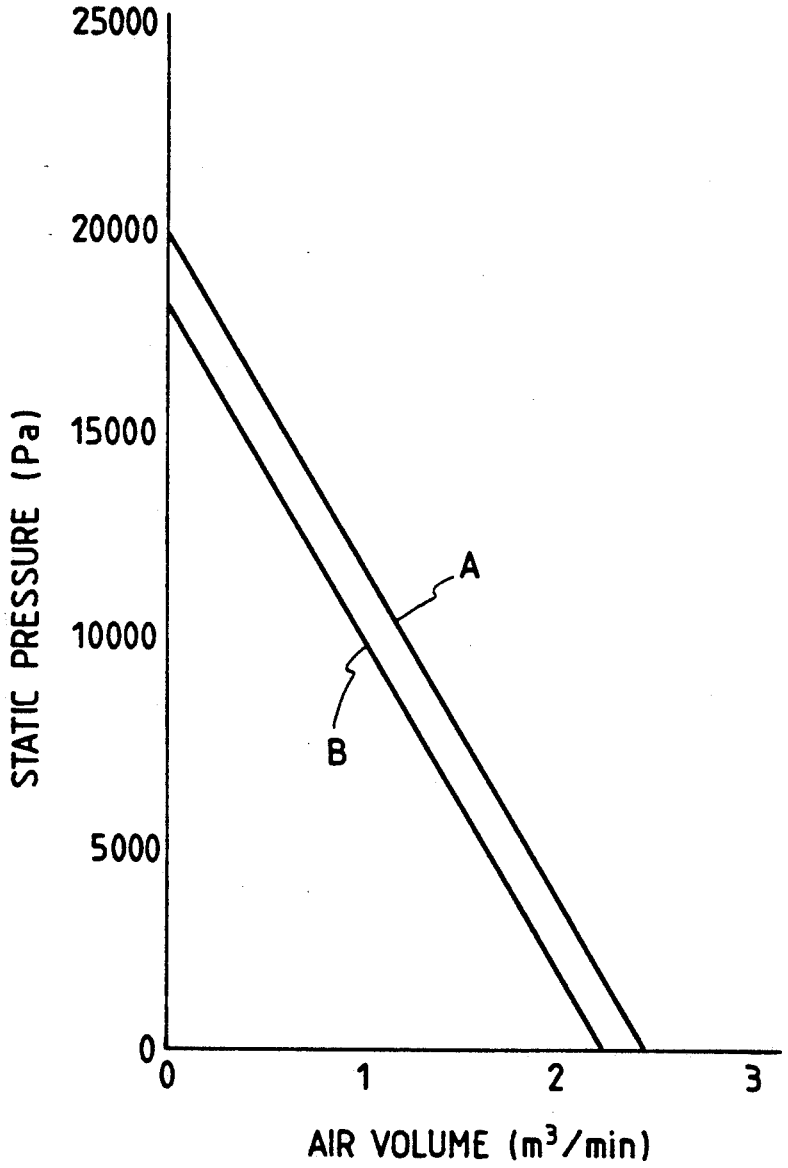
FIG. 38 is an aerodynamic characteristic diagram showing experimental results obtained with the embodiment of FIG. 34.

FIG. 38 is a characteristic diagram showing air volume - static pressure characteristic of the centrifugal blower of this embodiment and that of a conventional centrifugal blower. In the same figure, a curve A represents an aerodynamic characteristic obtained in the presence of the communication path according to this embodiment, while a curve B represents an aerodynamic characteristic obtained in the absence of such communication path according to the prior art. These characteristics were obtained under the following conditions: motor used . . . 0.75 kW, number of revolutions of the motor . . . 3,420 r.p.m., gap between the impeller and the partition wall . . . 0.3 mm, angle of the communication path . . . 12°. As is apparent also from this figure, the aerodynamic characteristic in this embodiment could be improved about 10% as a whole in comparison with that in the prior art.

Although in the above-described embodiments, the gas which is allowed to remain between adjacent vanes 1*a* is utilized as the auxiliary flow, the gas present in another position may be utilized as the auxiliary flow, or gas which has been pressurized by another means may be utilized for the same purpose. Particularly in this case, an auxiliary flow supply path need not be provided in such a form as a communication hole in the partition wall 3*d* and hence the degree of freedom increases with respect to the position where such path is to be provided. However, as in the above embodiments, if the gas compressed and allowed to remain between adjacent vanes 1*a* by the partition wall 3*d* is utilized as the auxiliary flow, it is possible to utilize the gas which causes disturbance, and the wetted perimeter length increases, so there can be obtained outstanding effects in various points related to performance, including efficiency. Further, although a centrifugal blower has been described in each of the above embodiments, the present invention is not limited thereto. It goes without saying that the invention is applicable to centrifugal pumps in a broad sense, including centrifugal gas and liquid pumps.

According to the present invention, as will be apparent from the above description, the performance of a centrifugal pump can be improved because it is possible to form a rotating flow more smoothly in an annular flow path.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

What is claimed is:

1. A vortex flow blower including a blower casing having an annular flow passage extending from an inlet port for receiving fluid to an outlet port for discharging the fluid, the outlet port being disposed adjacent to the inlet port, and an impeller accommodated in the blower casing for producing a vortex flow of the fluid in the annular flow passageway, means for driving the impeller, and enabling means for enabling at least one of noise reduction, pressure increase, and reduction of power requirements of the vortex flow blower, the enabling means including at least one of sectional area reducing means for reducing a sectional area of the annular flow passageway, the annular flow passageway including an annular groove disposed in facing relation to vanes of the impeller, and a partition wall partitioning a part of the circumference of the annular groove, the inlet port and the outlet portion being provided at opposite end portions of the annular groove partitioned by the partition wall, and at least one of (a) the sectional area reducing means being disposed at a position of the annular passageway located between the outlet port of the annular passageway and a midpoint between the inlet port and the outlet port of the annular passageway, and (b) means forming an auxiliary flow supply path being disposed for supplying an auxiliary flow of the fluid introduced to the annular flow passageway from the inlet port so as to conduct the fluid in a direction to form the vortex flow.

2. A vortex flow blower according to claim 1, wherein the sectional area reducing means reduces the area of the annular groove in a region extending from the proximity of an outer peripheral edge of the annular groove to at least the proximity of a bottom portion of the annular groove.

3. A vortex flow blower according to claim 2, wherein the sectional area reducing means provides a substantially flat surface portion extending between the outer peripheral edge to the bottom portion of the annular groove.

4. A vortex flow blower according to claim 2, wherein the sectional area reducing means provides an arcuate surface portion extending from the proximity of the outer peripheral edge to an inner peripheral edge of the annular groove.

5. A vortex flow blower according to claim 2, wherein the sectional area reducing means provides an undulating surface portion extending between the outer peripheral edge to the bottom portion of the annular groove.

6. A vortex flow blower according to claim 2, wherein the auxiliary flow is a carry-over flow which has been carried from the outlet port side of the annular passageway to the inlet port side of the impeller, the means forming the auxiliary flow supply path supplying the auxiliary flow to the annular flow passageway in a region adjacent the inlet port so as to form the vortex flow.

7. A vortex flow blower according to claim 1, wherein the sectional area reducing means includes at least one member separate from the blower casing forming the annular groove and is disposed in at least a portion of the annular groove.

8. A vortex flow blower according to claim 1, wherein said sectional area reducing means is formed integrally with the blower casing.

9. A vortex flow blower according to claim 1, wherein the sectional area reducing means provides the annular groove with a different depth from a surface of the casing facing the impeller.

10. A vortex flow blower according to clam 1, wherein the vortex flow blower is a centrifugal pump and the fluid is one of gas and liquid.

11. A vortex flow blower according to claim 1, wherein the sectional area reducing means is disposed in a region of the annular flow passageway extending over a circumferential area of about 112° from the midpoint toward the outlet port.

12. A vortex flow blower according to claim 1, wherein the impeller is of a double-side vane type having a first and a second plurality of vanes extending in opposite directions at an outer periphery thereof, the annular groove of the casing facing the first plurality of vanes, a side cover delimiting another annular groove at the outer periphery thereof in facing relation to the second plurality of vanes, the annular flow passageway including the annular groove of the casing and the another annular groove of the side cover, the sectional area reducing means being positioned in the annular flow passageway between the outlet port and the midpoint between the inlet port and the outlet port.

13. A vortex flow blower according to claim 12, wherein the sectional area reducing means reduces the area of the annular groove in a region extending from the proximity of an outer peripheral edge of the annular groove to at least the proximity of a bottom portion of the annular groove.

14. A vortex flow blower according to claim 13, wherein the sectional area reducing means provides a substantially flat surface portion extending between the outer peripheral edge to the bottom portion of the annular groove.

15. A vortex flow blower according to claim 13, wherein the sectional area reducing means provides an arcuate surface portion extending from the proximity of the outer peripheral edge to an inner peripheral edge of the annular groove.

16. A vortex flow blower according to claim 13, wherein the sectional area reducing means provides an undulating surface portion extending between the outer peripheral edge to the bottom portion of the annular groove.

17. A vortex flow blower according to claim 12, wherein the sectional area reducing means includes at least one member separate from the blower casing forming the annular groove and is disposed in at least a portion of the annular groove.

18. A vortex flow blower according to claim 12, wherein said sectional area reducing means is formed integrally with the blower casing.

19. A vortex flow blower according to claim 12, wherein the sectional area reducing means provides the annular groove with a different depth from a surface of the casing facing the impeller.

20. A vortex flow blower according to clam 12, wherein the vortex flow blower is a centrifugal pump and the fluid is one of gas and liquid.

21. A vortex flow blower according to claim 12, wherein the auxiliary flow is a carry-over flow which has been carried from the outlet port side of the annular passageway to the inlet port side of the impeller, the means forming the auxiliary flow supply path supplying the auxiliary flow to the annular flow passageway in a region adjacent the inlet port so as to form the vortex flow.

22. A vortex flow blower according to claim 1, wherein the auxiliary flow is a carry-over flow which has been carried from the outlet port side of the annular passageway to the inlet port side by the impeller, the means forming the auxiliary flow supply path supplying the auxiliary flow to the annular flow passageway in a region adjacent the inlet port so as to form the vortex flow.

23. A vortex blower according to claim 22, wherein the partition wall partitioning a part of the circumference of the annular groove is separated by a gap with respect to a vane passing path of the impeller, the means forming the auxiliary flow supply path enable supply of the auxiliary flow at an angle of about 5° to 35° relative to an advancing direction of the vane of the impeller using as a reference plane a surface of the partition wall for delimiting the gap with respect to the impeller.

24. A vortex flow blower according to claim 22, wherein the partition wall partitioning a part of the circumference of the annular groove is spaced from a vane passing path of the impeller by a gap, the means forming an auxiliary flow supply path including discharge guide means for guiding the carry-over flow carried from the outlet port side on the inlet port side of the partition wall so that the carry-over flow is discharged in an obliquely forward direction relative to an advancing direction of the vanes of the impeller using as a reference plane a surface of the partition wall which delimits the gap with respect to the impeller.

25. A vortex flow blower according to claim 24, wherein the discharge guide means includes a flow guide member disposed on the partition wall so as to discharge the carry-over flow in the obliquely forward direction at an angle of about 5° to 35° relative to the advancing direction of the vanes using as a reference plane the surface of the partition wall which delimits the gap with respect to the impeller.

26. A vortex flow blower according to claim 24, wherein the partition wall includes a flow guide portion for guiding the flow from the inlet port to both the annular flow passageway and the vanes of the impeller, and the discharge guide means is provided in the flow guide portion of the partition wall.

27. A vortex flow blower according to claim 26, wherein the discharge guide means is configured as a cut-out formed in the flow guide portion.

28. A vortex flow blower according to claim 27, wherein the discharge guide means formed by the cut-out in the flow guide portion has an opening on a side opposed to a vane of the impeller and in a position so that in a circumferential direction a rear end thereof is spaced from a rear end of the flow guide portion of the partition wall relative to the advancing direction of the vanes of the impeller at a distance of about 1.5 to 2.5 times the vane-to-vane spacing of the impeller.

29. A vortex flow blower according to claim 27, wherein the discharge guide means formed by the cut-out in the flow guide portion has an opening on a side opposed to a vane of the impeller and with an angle of a surface of the opening position forward relative to the advancing direction of the vane of about 5° to 35°.

30. A vortex flow blower according to claim 27, wherein the discharge guide means formed by the cut-out in the flow guide portion has an opening on a side opposed to a vane of the impeller and in a position outside of the position opposed to the vane of the impeller in a radial direction.

31. A vortex flow blower according to claim 27, wherein the discharge guide means formed by the cut-out in the flow guide portion has an opening on a side opposed to a vane of the impeller and the opening is positioned outside a central portion of the vane in the position opposed to the vane in a radial direction.

32. A vortex flow blower according to claim 27, wherein the discharge guide means formed by the cut-out in the flow guide portion has an opening on a side opposed to a vane of the impeller, the opening being positioned on an outer peripheral side at least 1/6 with respect to a central portion of the vane in the position opposed to the vane in a radial direction.

33. A vortex flow blower according to claim 27, wherein the discharge guide means formed by the cut-out in the flow guide portion has an opening on a side opposed to a vane of the impeller and the opening is positioned inside a central portion of the vane in the position opposed to the vane in a radial direction.

34. A vortex flow blower according to claim 27 wherein the discharge guide means formed by the cut-out in the flow guide portion has an opening on a side opposed to a vane of the impeller, the opening being positioned on an inner peripheral side at least 1/6 with respect to a central portion of the vane in the position opposed to the vane in a radial direction.

35. A vortex flow blower according to claim 26, wherein the discharge guide means formed by the cut-out in the flow guide portion has an opening on a side opposed to a vane of the impeller and in a position outside of the position opposed to the vane of the impeller in a radial direction.

36. A vortex flow blower according to claim 22, wherein the means forming the auxiliary flow path supplies the carry-over flow to the annular passageway within an angle of 40° from the inlet port.

37. A vortex flow blower according to claim 22, wherein the vortex flow blower is a centrifugal pump and the fluid is one of a gas and a liquid.

38. A vortex flow blower according to claim 1, wherein both (a) the sectional area reducing means disposed at the position of the annular passageway located between the outlet port of the annular passageway and the midpoint between the inlet port and the outlet port of the annular passageway, and (b) the means forming an auxiliary flow supply path disposed for supplying the auxiliary flow of the fluid introduced to the annular flow passageway from the inlet port so as to conduct the fluid in the direction to form the vortex flow are provided.

* * * * *